US011692770B2

(12) United States Patent
Park et al.

(10) Patent No.: US 11,692,770 B2
(45) Date of Patent: Jul. 4, 2023

(54) REFRIGERATOR

(71) Applicant: LG ELECTRONICS INC., Seoul (KR)

(72) Inventors: Jeongwon Park, Seoul (KR); Giseok Seong, Seoul (KR); Myungjin Chung, Seoul (KR); Kyungseok Kim, Seoul (KR); Jinho Kim, Seoul (KR); Tackwon Han, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 223 days.

(21) Appl. No.: 16/725,271

(22) Filed: Dec. 23, 2019

(65) Prior Publication Data

US 2020/0224963 A1 Jul. 16, 2020

(30) Foreign Application Priority Data

Jan. 10, 2019 (KR) ..... 10-2019-0003590

(51) Int. Cl.
*F25D 31/00* (2006.01)
*F25D 11/02* (2006.01)
(Continued)

(52) U.S. Cl.
CPC ..... *F25D 31/005* (2013.01); *F25D 11/02* (2013.01); *F25D 17/062* (2013.01);
(Continued)

(58) Field of Classification Search
CPC ..... F25D 2317/067; F25D 17/045; F25D 31/005; F25D 11/02; F25D 17/062;
(Continued)

(56) References Cited

U.S. PATENT DOCUMENTS 4,662,186 A 5/1987 Park
5,031,413 A 7/1991 Tsuihiji et al.
(Continued)

FOREIGN PATENT DOCUMENTS

CN 1061845 6/1992
CN 1247968 3/2000
(Continued)

OTHER PUBLICATIONS

European Search Report dated Jun. 19, 2020 issued in EP Application No. 20150256.4.
(Continued)

*Primary Examiner* — Ana M Vazquez
(74) *Attorney, Agent, or Firm* — Ked & Associates, LLP

(57) ABSTRACT

A refrigerator includes a cabinet formed with a chamber, a partition wall configured to partition the chamber into a storage space and an air flow path and including a discharge port and a suction port, and a heat exchanger provided in the air flow path, in which the air flow path includes a discharge flow path to guide air discharged to the discharge port, the discharge flow path has an inlet closer to a first side edge of the partition wall, and the suction port is formed closer to a vertical centerline of the partition wall than either of a first or second side edge of the partition wall.

19 Claims, 22 Drawing Sheets

(51) Int. Cl.
*F25D 17/06* (2006.01)
*F25D 17/08* (2006.01)
*F25D 23/02* (2006.01)

(52) U.S. Cl.
CPC ..... *F25D 17/067* (2013.01); *F25D 17/08* (2013.01); *F25D 23/028* (2013.01); *F25D 2317/061* (2013.01)

(58) Field of Classification Search
CPC ..... F25D 17/067; F25D 17/08; F25D 23/028; F25D 2317/061; F25D 2317/0671; F25D 2317/0672; F25D 17/06; F25D 11/022; F25D 23/006; F25D 23/069; F25D 2317/063; F25D 2400/02
See application file for complete search history.

(56) References Cited

U.S. PATENT DOCUMENTS

| | | | |
|---|---|---|---|
| 5,033,182 | A | 7/1991 | Winterheimer |
| 5,228,499 | A | 7/1993 | Yoon |
| 5,551,252 | A | 9/1996 | Lee |
| 5,758,512 | A | 6/1998 | Peterson et al. |
| 5,878,592 | A | 3/1999 | Borges et al. |
| 6,000,232 | A | 12/1999 | Witten-Hannah et al. |
| 6,058,723 | A | 5/2000 | Kusunoki et al. |
| 6,327,867 | B1 | 12/2001 | Hyodo et al. |
| 6,694,753 | B1 | 2/2004 | Lanz et al. |
| 7,971,443 | B2 | 7/2011 | Nishita et al. |
| 8,826,679 | B2 | 9/2014 | May et al. |
| 9,140,479 | B2 | 9/2015 | Gomes et al. |
| 9,599,353 | B2 | 3/2017 | Cur et al. |
| 10,126,040 | B1 | 11/2018 | Ribeiro et al. |
| 10,228,180 | B2 | 3/2019 | Oyu |
| 10,655,893 | B2 | 5/2020 | Saint Pierre et al. |
| 10,677,510 | B2 | 6/2020 | Kim |
| 10,712,074 | B2 | 7/2020 | Scalf et al. |
| 10,823,481 | B2 | 11/2020 | Gomes et al. |
| 2002/0116943 | A1 | 8/2002 | Tupis |
| 2003/0029178 | A1 | 2/2003 | Zentner et al. |
| 2004/0107726 | A1 | 6/2004 | Kim |
| 2004/0263038 | A1 | 12/2004 | Ribolzi |
| 2007/0000271 | A1 | 1/2007 | Lee et al. |
| 2007/0033956 | A1 | 2/2007 | Kang et al. |
| 2007/0074528 | A1 | 4/2007 | Rodriguez |
| 2008/0000256 | A1 | 1/2008 | Shin |
| 2008/0016889 | A1 | 1/2008 | Jung |
| 2008/0148748 | A1 | 6/2008 | Viegas et al. |
| 2008/0148761 | A1 | 6/2008 | Venkatakrishnan |
| 2008/0196427 | A1 | 8/2008 | Bianchi et al. |
| 2008/0202149 | A1 | 8/2008 | Lim |
| 2009/0015123 | A1 | 1/2009 | Lee |
| 2009/0188262 | A1 | 7/2009 | Schmid |
| 2009/0193826 | A1 | 8/2009 | Yasugi et al. |
| 2010/0070083 | A1 | 3/2010 | Kim et al. |
| 2010/0199709 | A1 | 8/2010 | Holland |
| 2011/0146333 | A1 | 6/2011 | Koo |
| 2011/0225994 | A1 | 9/2011 | Fotiadis et al. |
| 2012/0011882 | A1 | 1/2012 | Cho |
| 2012/0036882 | A1* | 2/2012 | Park ..... F25D 23/126 62/340 |
| 2012/0159974 | A1 | 6/2012 | Han |
| 2012/0204581 | A1 | 8/2012 | Kang et al. |
| 2013/0000333 | A1 | 1/2013 | Kim et al. |
| 2013/0174586 | A1 | 7/2013 | Kang et al. |
| 2014/0208783 | A1 | 7/2014 | Lee et al. |
| 2015/0000310 | A1 | 1/2015 | Lee et al. |
| 2015/0121918 | A1 | 5/2015 | Lee |
| 2015/0354860 | A1 | 12/2015 | Kacmaz |
| 2016/0153693 | A1 | 6/2016 | Oyu et al. |
| 2016/0273823 | A1 | 9/2016 | Cho et al. |
| 2017/0016271 | A1 | 1/2017 | Boucher |
| 2017/0074568 | A1 | 3/2017 | Orozco |
| 2017/0188721 | A1 | 7/2017 | Park et al. |
| 2017/0219254 | A1 | 8/2017 | Sul et al. |
| 2018/0038626 | A1 | 2/2018 | Kim et al. |
| 2018/0087814 | A1 | 3/2018 | Han et al. |
| 2018/0163748 | A1 | 6/2018 | Hayamitsu et al. |
| 2018/0172331 | A1 | 6/2018 | Tomohiko |
| 2018/0274844 | A1 | 9/2018 | Lee |
| 2018/0299182 | A1* | 10/2018 | Besore ..... F25D 17/065 |
| 2018/0363974 | A1 | 12/2018 | Costa et al. |
| 2021/0010738 | A1 | 1/2021 | Choi |
| 2021/0055034 | A1 | 2/2021 | Choi |
| 2021/0285714 | A1 | 9/2021 | Heo et al. |

FOREIGN PATENT DOCUMENTS

| | | |
|---|---|---|
| CN | 1367364 | 9/2002 |
| CN | 101048633 | 10/2007 |
| CN | 102121779 | 7/2011 |
| CN | 103968633 | 8/2014 |
| CN | 103033013 | 4/2015 |
| CN | 105164478 | 12/2015 |
| CN | 105890268 | 8/2016 |
| CN | 108302874 | 7/2018 |
| CN | 108369052 | 8/2018 |
| DE | 698 31028 | 5/2006 |
| DE | 10 2008 054 934 | 7/2010 |
| EP | 1 806 553 | 7/2007 |
| EP | 2 078 908 | 7/2009 |
| EP | 3 190 364 | 7/2017 |
| EP | 3 301385 | 4/2018 |
| EP | 3 338 041 | 6/2018 |
| JP | H10-300316 | 11/1998 |
| JP | H10-332239 | 12/1998 |
| JP | 2000-105048 | 4/2000 |
| JP | 2000-258028 | 9/2000 |
| JP | 2002-039663 | 2/2002 |
| JP | 2002-130908 | 5/2002 |
| JP | 2002-206840 | 7/2002 |
| JP | 2003-139454 | 5/2003 |
| JP | 2003-322454 | 11/2003 |
| JP | 2006-242463 | 9/2006 |
| JP | 2009-041883 | 2/2009 |
| JP | 2009-229018 | 10/2009 |
| JP | 2010-071606 | 4/2010 |
| JP | 2012-242074 | 12/2012 |
| KR | 20-0380906 | 4/2005 |
| KR | 10-2008-0003654 | 1/2008 |
| KR | 10-2011-0020482 | 3/2011 |
| KR | 10-2011-0027562 | 3/2011 |
| KR | 10-2018-0084516 | 7/2018 |
| WO | WO 2005/052474 | 6/2005 |
| WO | WO 2008/120862 | 10/2008 |
| WO | WO 2016/175562 | 11/2016 |
| WO | WO 2017/152580 | 9/2017 |

OTHER PUBLICATIONS

Wine Guardian®—wine cooling, split system, and calculator (2021) (Year: 2021).
U.S. Office Action dated Oct. 1, 2021 issued in U.S. Appl. No. 16/725,428.
European Search Report dated May 26, 2020 issued in EP Application No. 20150246.5.
European Search Report dated May 26, 2020 issued in EP Application No. 20150251.5.
European Search Report dated May 26, 2020 issued in EP Application No. 20150252.3.
Chinese Office Action dated Jul. 1, 2021 issued in Application No. 201911395312.6.
United States Office Action dated Oct. 6, 2021 issued in co-pending related U.S. Appl. No. 16/725,166.
Chinese Office Action dated Apr. 26, 2021 issued in CN Application No. 201911393284.4.
Chinese Office Action dated Apr. 26, 2021 issued in CN Application No. 202010017928.6.
United States Office Action dated Jul. 15, 2021 issued in U.S. Appl. No. 16/725,071.

(56) References Cited

OTHER PUBLICATIONS

Chinese Office Action dated May 28, 2021 issued in CN Application No. 202010018245.2.
U.S. Office Action dated Aug. 31, 2021 issued in U.S. Appl. No. 16/725,318.
Eccentrically, Merriam-Webster, https://merriam-webster.com/dictionary/eccentrically (Year: 2021).
What's the Difference Between a Gasket and a Seal, Aero Rubber Co., https://aerorubber.com/2020/05/28/whats-the-difference-between-a-gasket-and-a-seal/ (Year: 2021).
United States Office Action dated Jul. 26, 2021 issued in co-pending related U.S. Appl. No. 16/725,092.
European Search Report dated May 25, 2020 issued in EP Application No. 20150244.0.
European Search Report dated May 25, 2020 issued in EP Application No. 20150245.7.
European Search Report dated May 25, 2020 issued in EP Application No. 20150248.1.
Refrigerant Pump-Down Method, HVAC Refrigeration, High Performance HVAC, Oct. 2016 (October)—18 (Year: 2021).
United States Office Action dated Dec. 17, 2021 issued in co-pending related U.S. Appl. No. 16/725,071.
U.S. Office Action dated Sep. 17, 2021 issued in U.S. Appl. No. 16/725,436.
United States Office Action dated Feb. 15, 2022 issued in co-pending related U.S. Appl. No. 16/725,318.
Damper Definition & Meaning—Merriam-Webster, 2022 (Year: 2022).
U.S. Appl. No. 16/725,551, filed Dec. 23, 2019.
U.S. Appl. No. 16/725,166, filed Dec. 23, 2019.
U.S. Appl. No. 16/725,071, filed Dec. 23, 2019.
United States Notice of Allowance dated Mar. 23, 2022 issued in co-pending related U.S. Appl. No. 16/725,166.
United States Office Action dated Mar. 24, 2022 issued in co-pending related U.S. Appl. No. 16/725,428.
United States Office Action dated Mar. 29, 2022 issued in co-pending related U.S. Appl. No. 16/725,551.
United States Notice of Allowance dated Jun. 23, 2022 issued in co-pending related U.S. Appl. No. 16/725,071.
United States Office Action dated Sep. 28, 2022 issued in co-pending related U.S. Appl. No. 16/725,318.
U.S. Office Action dated Jan. 10, 2023 issued in U.S. Appl. No. 16/725,428.
Quest Climate-Humidity Control in Freezers, https://www.questclimate.com/humidity-control-freezers/, 2021 (Year: 2021).
European Office Action dated Sep. 27, 2022 issued in EP Application No. 20150251.5.
European Office Action dated Sep. 27, 2022 issued in EP Application No. 20150252.3.
U.S. Notice of Allowance dated Oct. 20, 2022 issued in U.S. Appl. No. 16/725,551.
United States Office Action dated Nov. 18, 2022 issued in co-pending related U.S. Appl. No. 16/725,436.
U.S. Appl. No. 16/725,428, filed Dec. 23, 2019.
U.S. Appl. No. 16/725,436, filed Dec. 23, 2019.
U.S. Appl. No. 16/725,092, filed Dec. 23, 2019.
U.S. Appl. No. 16/725,271, filed Dec. 23, 2019.
U.S. Appl. No. 16/725,318, filed Dec. 23, 2019.
U.S. Office Action dated Apr. 12, 2023 issued in U.S. Appl. No. 16/725,092.
U.S. Office Action dated Apr. 24, 2023 issued in U.S. Appl. No. 16/725,436.

* cited by examiner

REFRIGERATOR

CROSS-REFERENCE TO RELATED APPLICATION(S)

This application claims priority under 35 U.S.C. 119 and 35 U.S.C. 365 to Korean Patent Application No. 10-2019-0003590, filed in Korea on Jan. 10, 2019, in Korea, the entire contents of which are hereby incorporated by reference in its entirety.

BACKGROUND

1. Field

The present disclosure relates to a refrigerator.

2. Background

A refrigerator is an appliance that allows food or other goods to be stored at a relatively low temperature in an internal storage space accessed by a door.

BRIEF DESCRIPTION OF THE DRAWINGS

Embodiments will be described in detail with reference to the following drawings in which like reference numerals refer to like elements, and wherein.

DETAILED DESCRIPTION

Figure 1:
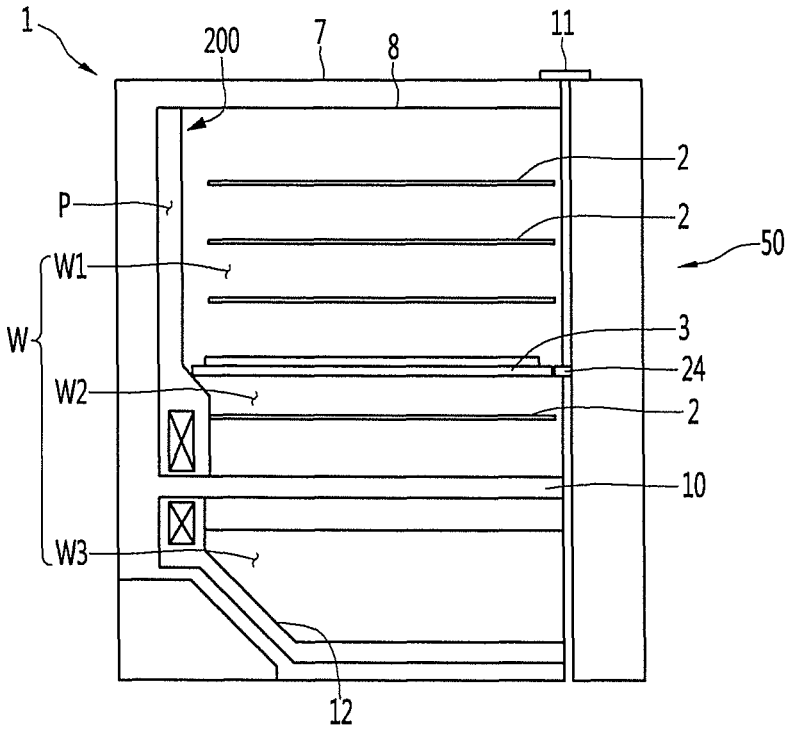
FIG. 1 is a sectional view illustrating an example of a refrigerator according to an embodiment of the present disclosure.

FIG. 1 is a sectional view illustrating an example of a refrigerator according to an embodiment of the present disclosure. The refrigerator may have a storage chamber W in which goods and the like may be stored. The refrigerator may include a cabinet 1 in which the storage chamber W is formed. The refrigerator may further include a door 50 that opens and closes the storage chamber W. The door 50 may include at least one of a rotatable door 5 and an advancing and retracting type (or drawer type) door 6. The cabinet 1 may include an outer case 7 forming an outer appearance and an inner case 8 forming at least one surface for forming the storage chamber W therein.

The storage chamber W may be a storage chamber in which certain kinds of goods which are preferably stored at a specific temperature range are stored. For example, the storage chamber W may be a dedicated storage chamber for storing certain goods that need to be kept warm or cold, for example, alcoholic liquors such as wine and beer, fermented foods, cosmetics, and medical supplies, for example. As one example, the storage chamber for wine can be maintained at a temperature of 3° C. to 20° C., or a higher temperature than the refrigerating chamber of a normal refrigerator, and may not exceed 20° C. The temperature of the storage chamber for red wine may be adjusted to 12° C. to 18° C., the temperature of the storage chamber for white wine may be adjusted to 6° C. to 11° C. In some examples, the temperature of the storage chamber for champagne may be adjusted to about 5° C.

The temperature of the storage chamber W may be adjusted such that the storage chamber temperature fluctuates between a target temperature upper limit value and a target temperature lower limit value of the storage chamber W. The quality of the goods stored in the storage chamber W may be reduced by the difference between the target temperature upper limit value and the target temperature lower limit value (hereinafter, referred to as storage chamber temperature difference). The refrigerator may be manufactured with a small storage chamber temperature difference according to the type of the goods and may minimize the reduction of the quality of the goods. The storage chamber W of the refrigerator of the present embodiment may be a storage chamber having a smaller storage chamber temperature difference than that of a general refrigerator. Specifically, the storage chamber temperature difference of the storage chamber W may be less than 3° C., or may be 2° C. as an example. Of course, in a case of considering goods very sensitive to temperature changes, the storage chamber temperature difference may be less than 1° C.

The refrigerator may include a device capable of adjusting the temperature of the storage chamber W (hereinafter, referred to as a "temperature adjusting device" or "heat exchanger"). The temperature adjusting device or heat exchanger may include at least one of cooling device and heating device. The temperature adjusting device may cool or heat the storage chamber W by at least one of conduction, convection, and radiation. For example, a cooling device such as an evaporator 150 or a heat absorbing body of a thermoelectric element may be attached to the inner case 8 to cool the storage chamber W by conduction. By adding an airflow forming mechanism such as a fan, the air heat-exchanged with the cooling device by convection can be supplied to the storage chamber W.

A heating device such as a heater or a heat generating body of the thermoelectric element may be attached to the inner case 8 to heat the storage chamber W by conduction. The addition of an airflow forming mechanism such as a fan may supply heat to the storage chamber W by convection. In the present specification, the cooling device may be defined as a device capable of cooling the storage chamber W, including at least one of the evaporator 150, the heat absorbing body of the thermoelectric element, and the fan. In addition, the heating device may be defined as a device capable of heating the storage chamber W, including at least one of a heater, a heat generating body of the thermoelectric element, and a fan.

The refrigerator may further include an inner guide (or partition wall) 200. The inner guide 200 may partition an inner portion of the inner case 8 into a space in which goods are stored and a space in which a temperature adjusting device is located (hereinafter referred to as a "temperature adjusting device chamber"). The temperature adjusting device chamber may be a cooling device chamber and a heating device chamber.

For example, the temperature adjusting device chamber may be located between the inner guide 200 and the inner case 8, between the inner guide 200 and the outer case 7, or inside the inner guide 200. The inner guide 200 may partition a cold air flow path P for supplying cold air to the space where goods are stored and the storage chamber W, and at least one of the cooling device may be provided in the cold air flow path P.

The inner guide 200 may partition a space in which goods are stored and a hot air flow path P for supplying heat to the storage chamber W, and at least one of the heating device may be arranged in the hot air flow path P. The inner guide for the cooling device and the inner guide for the heating device may be designed in common and may be manufactured separately. The inner guide 200 may form a storage space together with the inner case 8. The inner guide 200 may be provided in front of the rear body of the inner case.

The refrigerator may include both a refrigerator having one space having the same storage chamber temperature range of the storage chamber W and a refrigerator having two or more spaces having different storage temperature ranges from each other.

The refrigerator may further include a partition member (or partition shelf) 3 arranged vertically or horizontally in order to divide the storage chambers W into two or more spaces (for example, a first space W1 and a second space W2) which may have different storage chamber temperatures range from each other. The refrigerator may further include the partition member 10 arranged vertically or horizontally in order to divide the storage chambers W into two or more spaces (for example, a second space W2, a third space W3) which have different storage chamber temperature ranges from each other. The partition member 10 may be separately manufactured and then mounted in the inner case 8. The partition member 10 may be manufactured by foaming together with a heat insulating material provided between the outer case 7 and the inner cases 8 and 9.

The two or more spaces may be different in size. For example, the first space W1 may be located at the upper side, the second space W2 may be located at the lower side, and the partition member 3 may be arranged so that the size of the first space W1 is larger than the size of the second space W2. The first storage chamber temperature for the first space W may be higher than the second storage chamber temperature for the second space W2.

According to an embodiment, the first storage chamber temperature may be higher than the second storage chamber temperature, the maximum value of the first storage chamber temperature may be greater than the maximum value of the second storage chamber temperature, the average value of the first storage chamber temperature may be greater than the average value of the second storage chamber temperature, and the minimum value of the first storage chamber temperature may be greater than the minimum value of the second storage chamber temperature. The refrigerator may further include a door (hereinafter, a see-through door) through which the user can see the storage chamber through a see-through window without opening the door 50 from the outside of the refrigerator, and the see-through door will be described later.

The refrigerator may further include a transparent gasket 24 provided on at least one of the see-through door and the partition members 3 and 10. When the see-through door closes the storage chamber W, the transparent gasket 24 may partition the storage chamber W into two or more spaces having different storage temperature ranges from each other together with the partition members 3 and 10.

The refrigerator may further include door opening modules 11 and 11' for forcibly opening the door 50. The door opening modules 11 and 11' may be a rotatable door opening module 11 which can allow the door 5 to be rotated more than a predetermined angle without the user holding the door 5, or an advancing and retracting type door opening module 11' which can allow the door 6 to be advanced and retracted in a front and rear direction. The door opening modules 11 and 11' will be described later. The refrigerator may further include a lifting module 13 capable of lifting or lowering the holder 12, and although not illustrated in FIG. 1, the lifting module may be located in at least one of the storage chamber and the door.

The refrigerator may include a plurality of doors for opening and closing two or more spaces having different storage temperature ranges from each other. At least one of the plurality of doors may be a see-through door. At least one of the cabinet 1 or the plurality of doors may include door opening modules 11 and 11'. A lifting module 13 for lifting and lowering the holder 12 located in the storage chamber to open and close may be provided on at least one of the plurality of doors. For example, the door for the storage chamber located at the top may be a see-through door, and a lifting module 13 for lifting and lowering the holder of the storage chamber located at the lower portion may be disposed.

Figure 2:
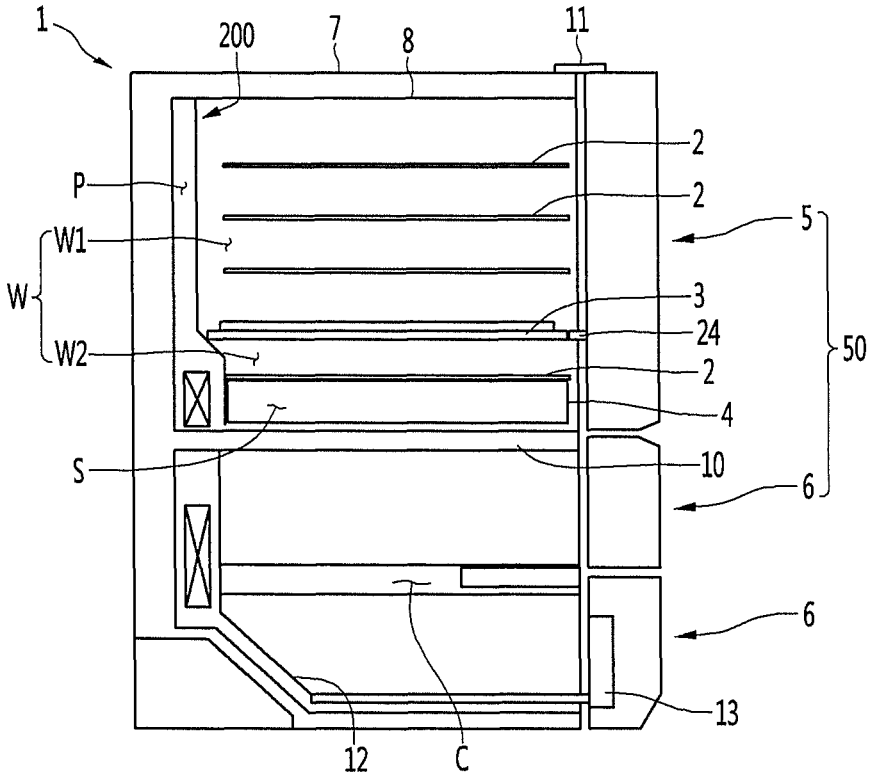
FIG. 2 is a sectional view illustrating another example of a refrigerator according to an embodiment of the present disclosure.

FIG. 2 is a sectional view illustrating another example of a refrigerator according to an embodiment of the present disclosure. Hereinafter, the storage chamber W illustrated in FIG. 1 will be described as a first storage chamber W. The refrigerator may further include at least one first storage chamber W and at least one second storage chamber C that may be temperature-controlled independently of the first storage chamber W. Hereinafter, a detailed description of the same configuration and operation as those of the storage chamber W illustrated in FIG. 1 will be omitted for the first storage chamber W, and a different configuration and operation from the storage chamber W illustrated in FIG. 1 will be described.

The second storage chamber C may be a storage chamber having a temperature range lower than the temperature range of the first storage chamber W, and for example, may be a storage chamber having a temperature range of −24° C. to 7° C. and the second storage chamber C may be a storage chamber which is temperature-controlled based on a target temperature, which is a temperature selected by a user within a temperature range of −24° C. to 7° C.

The second storage chamber C may be composed of a switching chamber (or a temperature changing chamber) in which any one of a plurality of temperature ranges may be selected, and may be configured as a non-switching chamber having one temperature range. The switching chamber may be a storage chamber which can be temperature-controlled to a selected temperature range among a plurality of temperature ranges, and the plurality of temperature ranges may include a first temperature range above zero, a second temperature range below zero, and a third temperature range between the first temperature range and the second temperature range.

For example, the user may supply an input to an input unit to select the second storage chamber C as a mode (for example, a refrigerating chamber mode) that is a temperature range above zero, and the temperature range of the second storage chamber C may be selected within a temperature range above zero (for example, 1° C. to 7° C.). The user may supply an input to an input unit to further input a desired temperature in the temperature range above zero, and the target temperature of the second storage chamber C may be a specific temperature (for example, 4° C.) entered by a user in the temperature range (for example, 1° C. to 7° C.) above zero.

The user may supply an input to the input unit and thus select as a mode in which the second storage chamber C is in the temperature range below zero (for example, freezing chamber mode) or a special mode (for example, a mode for storing a certain kind of goods or kimchi storage mode). The first storage chamber W may be a specific goods storage chamber in which a particular kind of goods which is preferably stored at a specific temperature range is stored or mainly a certain kind of goods are stored, and the second storage chamber C may be a non-specific goods storage chamber in which a various kinds of goods may be stored in addition to a specific kind of goods.

Examples of specific goods may include alcoholic beverages including wine, fermented foods, cosmetics, and medical supplies. For example, the first storage chamber W may be a storage chamber in which wine is stored or a wine chamber in which wine is mainly stored, and the second storage chamber C may be a non-wine chamber in which goods other than wine are stored or goods other than wine are mainly stored.

A storage chamber having a relatively small storage chamber temperature difference among the first storage chamber W and the second storage chamber C may be defined as a constant temperature chamber, and a storage chamber having a relatively large storage chamber temperature difference among the first storage chamber W and the second storage chamber C may be defined as a non-constant temperature chamber. Any one of the first storage chamber W and the second storage chamber C may be a priority storage chamber which is controlled in priority, and the other may be a subordinate storage chamber which is controlled secondarily to the priority chamber.

The first goods having a large or expensive quality change according to the temperature change may be stored in the priority storage chamber, and the second goods having a small or low quality change according to the temperature change may be stored in the subordinate storage chamber. The refrigerator may perform a specific operation for the priority storage chamber and a specific operation for the subordinate storage chamber.

The specific operation may include a general operation and a special operation for the storage chamber. A general operation may be defined as a conventional cooling operation for the storage chamber cooling. The special operation may be defined as a defrost operation for defrosting cooling device, a door load response operation that can be performed when predetermined conditions are satisfied after the door is opened, and an initial power supply operation, which is an operation when the power is first supplied to the refrigerator.

The refrigerator may be controlled such that a specific operation for the priority storage chamber is performed first when two operations may be performed simultaneously. Here, the simultaneous operation may be defined in a case where the start condition of the first operation and the start condition of the second operation are satisfied at the same time, as a case where the start condition of the first operation is satisfied and thus the start condition of the second operation is satisfied while the first operation is in progress, and as a case where the start condition of the second operation is satisfied and thus the start condition of the first operation is satisfied while the second operation is in progress.

For example, in the refrigerator, the priority storage chamber may be cooled or heated prior to the subordinate storage chamber when the temperature of the priority storage chamber is not satisfied and the temperature of the subordinate storage chamber is not satisfied. While the cooling device for cooling the subordinate storage chamber is defrosted, if the temperature of the priority storage chamber is not satisfied, the priority storage chamber may be cooled or heated while the cooling device of the subordinate storage chamber is defrosted.

If the temperature of the priority storage chamber is not satisfied while the subordinate storage chamber is in progress of the door load response operation, the priority storage chamber may be cooled or heated during the door load response operation of the subordinate storage chamber. Any one of the first storage chamber W and the second storage chamber C may be a storage chamber in which the temperature is adjusted by the first cooling device and the heating device, and the other may be a storage chamber in which the temperature is adjusted by the second cooling device.

In the refrigerator, a separate receiving member 4 may be additionally disposed in at least one of the first space W1 and the second space W2. In the receiving member 4, a separate space S (hereinafter, referred to as a receiving space) may be formed separately from the first space W1 and the second space W2 to accommodate goods. The refrigerator may adjust the receiving space S of the receiving member 4 to a temperature range different from that of the first space W1 and the second space W2.

The receiving member 4 may be located in the second space W2 located below the first space W1. The receiving space S of the receiving member 4 may be smaller than the second space W2. The storage chamber temperature of the receiving space S may be equal to or less than the storage chamber temperature of the second space W2.

In the refrigerator, in order to dispose as many shelves 2 as possible in the first storage chamber W, the length of the refrigerator itself in the vertical direction may be longer than the width in the horizontal direction, and in this case, the length of the refrigerator in the vertical direction may be more than twice the width in the horizontal direction. Since the refrigerator may be rolled over if the length in the vertical direction is too long relative to the width in the horizontal direction, the length in the vertical direction may be less than three times the width in the horizontal direction.

Preferred examples of the length in the vertical direction that can store a plurality of the specific goods may be 2.3 to 3 times the width in a left and right direction, and the most preferred example may be 2.4 to 3 times the width in the left and right direction. Even if the length of the refrigerator in the vertical direction is longer than the width in the left and right direction, in a case where the length of the storage chamber in which the specific goods are substantially stored, for example, the first storage chamber W, in the vertical direction is short, the number of specific goods may not be high. In the refrigerator, the length of the first storage chamber W in the vertical direction may be longer than the length of the second storage chamber C in the vertical direction so that a space for the specific goods may be as large as possible. For example, the length of the first storage chamber W in the vertical direction may be 1.1 times to 1.5 times the length of the second storage chamber C in the vertical direction.

At least one of the first door 5 and the second door 6 may be a see-through door, and the see-through door will be described later. The refrigerator may further include door opening modules 11 and 11' for forcibly opening at least one of the first door 5 and the second door 6 to the door opening modules 11 and 11', and the door opening modules 11 and 11' will be described later. In at least one of the first storage chamber W, the second storage chamber C, and the first door 5 and the second door 6, a lifting module 13 capable of lifting the holder 12 may be provided, and the lifting module 13 will be described later.

Figure 3:
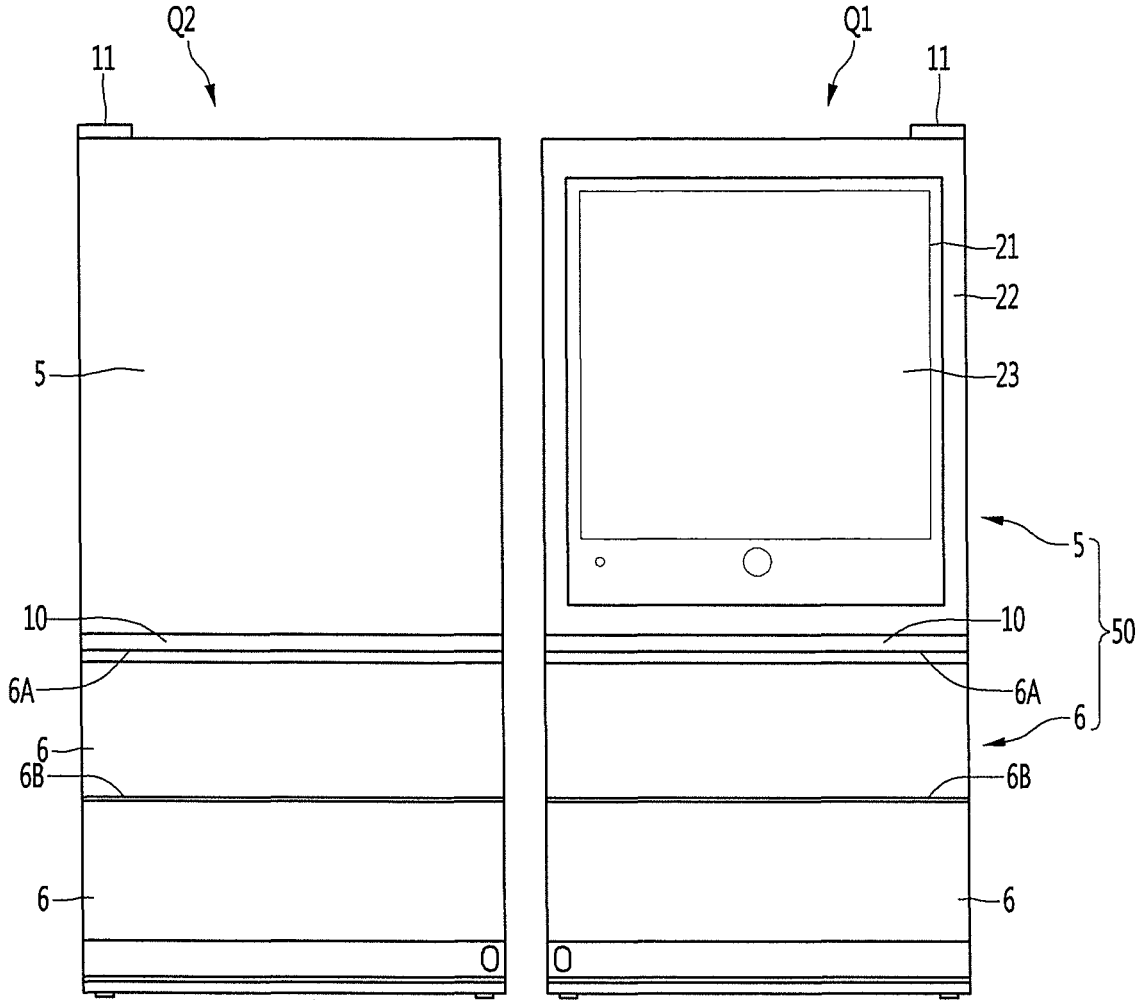
FIG. 3 is a front view when a refrigerator according to an embodiment of the present disclosure is disposed adjacent to another refrigerator.

Referring to FIG. 3, the refrigerator of the present embodiment may be provided adjacent to other refrigerators. A pair of adjacent refrigerators may be provided in the left and right direction, hereinafter, for convenience of description, the first refrigerator Q1 and the second refrigerator Q2 will be referred for description thereof, and the same configuration of the first refrigerator Q1 and the second refrigerator Q2 as each other will be described using the same reference numerals for convenience of description. In the refrigerator of the present embodiment, a plurality of storage chambers may be located in the left and right direction and the vertical direction in one outer case, such as a side by side type refrigerator or a French door type refrigerator.

At least one of the first refrigerator Q1 and the second refrigerator Q2 may be a refrigerator to which an embodiment of the present disclosure is applied. Although the first refrigerator Q1 and the second refrigerator Q2 have some functions different from each other, the lengths of the first and second refrigerators Q1 and Q2 in the vertical direction may be the same or almost similar so that the overall appearance may give the same or similar feeling when arranged adjacent to each other in the left and right direction.

Each of the first refrigerator Q1 and the second refrigerator Q2 may include each of a first storage chamber and a second storage chamber, and the first storage chamber and the second storage chamber may include a partition member 10 partitioning in the vertical direction, respectively. The partition member 10 of the first refrigerator Q1 and the partition member 10 of the second refrigerator Q2 may overlap in the horizontal direction.

The lower end 6A of the second door 6 opening and closing the second storage chamber of the first refrigerator Q1 and the lower end 6A of the second door 6 opening and closing the second storage chamber of the second refrigerator Q2 may coincide with each other in the horizontal direction. The lower end 6B of the second door 6 opening and closing the second storage chamber of the first refrigerator Q1 and the lower end 6B of the second door 6 opening and closing the second storage chamber of the second refrigerator Q2 may coincide with each other in the horizontal direction.

Figure 4:
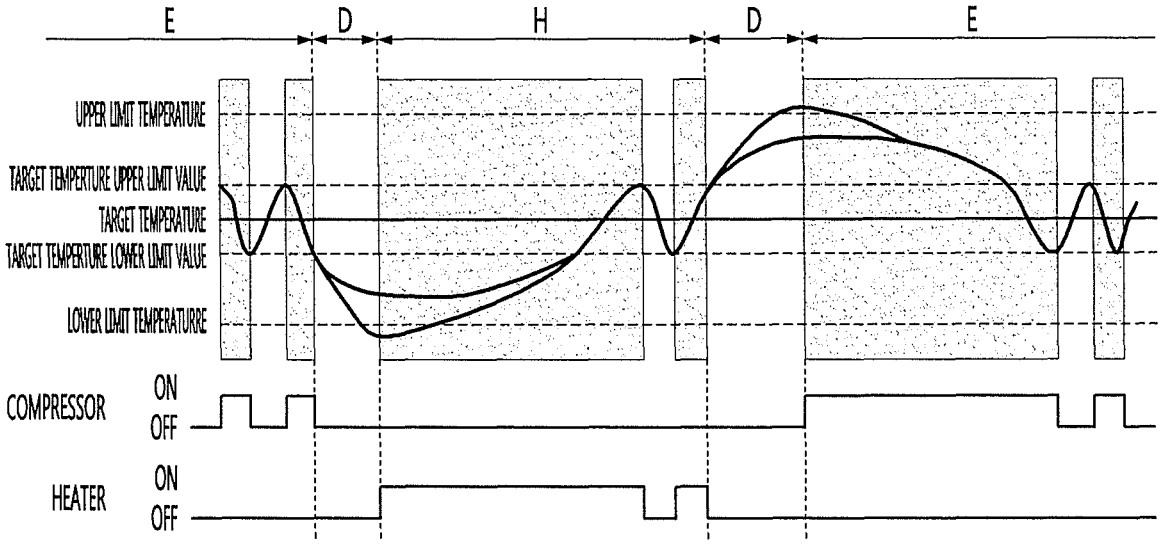
FIG. 4 is a view illustrating on and off of cooling device and on and off of heating device according to the temperature change of the storage chamber according to an embodiment of the present disclosure.

Referring to FIG. 4, the refrigerator may include cooling device and heating device that may be independently controlled to control the temperature of the storage chamber W. The refrigerator may include cooling device and heating device for controlling the temperature of at least one storage chamber among a specific goods storage chamber, a constant temperature chamber, and a priority storage chamber.

The refrigerator may be controlled in a plurality of modes for temperature adjusting of the storage chamber W, and the plurality of modes may include a cooling mode E in which the storage chamber W is cooled by the cooling device, a heating mode H in which the storage chamber W is heated by the heating device, and a standby mode D which maintains the current state without cooling or heating the storage chamber W.

The refrigerator may include a temperature sensor for sensing a temperature of the storage chamber W and a controller which may perform the cooling mode E, the heating mode H, and the standby mode D according to the storage chamber temperature sensed by the temperature sensor. The cooling mode E is not limited to that the storage chamber W is continuously cooled by the cooling device and may include a case where the storage chamber is cooled by the cooling device as a whole, but the storage chamber W is temporarily not cooled by the cooling device and a case where the storage chamber W is cooled by the cooling device as a whole, but the storage chamber is temporarily heated by the heating device. The cooling operation E may include a case where the time when the storage chamber is cooled by the cooling device is longer than the time when the storage chamber W is not cooled by the cooling device.

The heating mode H is not limited to the storage chamber W being continuously heated by the heating device and may include a case where the storage chamber W is heated by the heating device as a whole, but the storage chamber W is temporarily not heated by the heating device and a case where the storage chamber W is heated by the heating device as a whole, but the storage chamber W is temporarily cooled by the cooling device. The heating operation H may include a case where the time when the storage chamber W is heated by the heating device is longer than the time when the storage chamber W is not heated by the heating device.

There is a case where the temperature of the storage chamber W, which has been temperature-controlled by the cooling mode E, may be kept below a target temperature lower limit value without lifting above the target temperature lower limit value for a long time in a state of being lowered below the target temperature lower limit value. In this case, the refrigerator may start the heating mode H so that the storage chamber W is not overcooled when the storage chamber temperature falls below the lower limit temperature, and the heating device can be turned on. The lower limit temperature may be a temperature set to be lower than the target temperature lower limit value by the predetermined amount.

The refrigerator may then start the heating mode H so that the storage chamber temperature is not maintained in a low state for a long time when the storage chamber temperature is maintained between the target temperature lower limit value and the lower limit temperature during the setting time. The heating mode H may be started when the storage temperature is at the lower limit temperature, and the lower limit temperature may be the heating mode start temperature. One example of the standby mode D may be a mode in which the storage chamber temperature is maintained between the target lower limit value and the lower limit temperature, the refrigerator may be controlled in the order of the cooling mode E, the standby mode D, and the heating mode H without immediately switching to the heating mode H during the cooling mode E.

The temperature of the storage chamber W, which has been temperature-controlled by the heating mode H, may be kept above the target temperature upper limit value without being lowered below the target temperature upper limit value for a long time in a state of lifting above the target temperature upper limit value. In this case, when the storage chamber temperature exceeds the upper limit temperature, the refrigerator can start the cooling mode E so that the storage chamber W is not overheated, and the cooling device can be turned on. The upper limit temperature may be a temperature set to be higher than a target temperature upper limit value.

The refrigerator may start the cooling mode E so that the storage chamber temperature does not remain high for a long time when the storage chamber temperature is maintained between the target temperature upper limit value and the upper limit temperature during the setting time. The cooling mode E may be started if the storage temperature is the upper limit temperature, and the upper limit temperature may be the cooling mode start temperature.

Another example of the standby mode D may be a mode in which the storage chamber temperature is maintained between the target temperature upper limit value and the upper limit temperature, and without switching to the cooling mode E immediately during the heating mode H, the refrigerator may be controlled in the order of the heating mode H, the standby mode D, and the cooling mode E. For example, the cooling mode E may be a mode in which the refrigerant passes through the evaporator, the air in the storage chamber W is cooled by the evaporator, and then flows into the storage chamber W.

In the cooling mode E, the compressor may be turned on or off according to the temperature of the storage chamber W. In the cooling mode E, the compressor may be turned on or off such that the storage chamber temperature is maintained between the target temperature upper limit value and the target temperature lower limit value. Specifically, the compressor may be turned on because the cooling is not satisfied when the storage chamber temperature reaches the target temperature upper limit value and may be turned off when cooling is satisfied when the storage chamber temperature reaches the target temperature lower limit value.

For example, in the heating mode H, the heater may be turned on or off so that the storage chamber temperature is maintained between the target temperature upper limit value and the target temperature lower limit value. For example, the heater may be turned off because heating is satisfied when the storage chamber temperature reaches the target temperature upper limit value and may be turned on because heating is not satisfied when the storage chamber temperature reaches the target temperature lower limit value.

For example, the standby mode D may be a mode in which the refrigerant does not pass through the evaporator and the heater maintains the off state. The standby mode D may be a mode in which air in the storage chamber W is not forced to flow by the storage chamber fan. The standby mode D may be a mode in which the heater also maintains the off state while the compressor maintains the off state.

The plurality of modes may further include a humidification mode for increasing the humidity of the storage chamber. The humidification mode may be a mode in which air in the storage chamber W may be humidified by flowing into the cooling device chamber by a fan, and the humidified air may flow into the storage chamber W to humidify the storage chamber, in a state where at least a portion of the cooling device is in an off state (for example, the supply of refrigerant to the evaporator is interrupted, the thermoelectric element is turned off), and at least some of the heating device is maintained in an off state (for example, the heater is turned off and the thermoelectric element is turned off). For example, the humidification mode may be a mode in which the air in the storage chamber flows to the evaporator by a fan to humidify, and the humidified air flows into the storage chamber to humidify the storage chamber, in a state where the heater maintains in an off state while the refrigerant does not pass through the evaporator. In the humidification mode, a fan that circulates air in the storage chamber to the evaporator and the storage chamber may be driven.

The refrigeration cycles illustrated in FIGS. 5 to 8 may be applied to a refrigerator having three spaces (hereinafter, referred to as 1, 2, and 3 spaces) having different storage temperature ranges from each other. For example, The refrigeration cycles may be applied to at least one of i) a refrigerator having a first space W1, a second space W2, and a third space W3, ii) a refrigerator having a first storage chamber W having the first space W1 and the second space W2, and a second storage chamber C partitioned from the first storage chamber W, and iii) a refrigerator having a first storage chamber W and two second and third storage chambers partitioned from the first storage chamber W.

Figure 5:
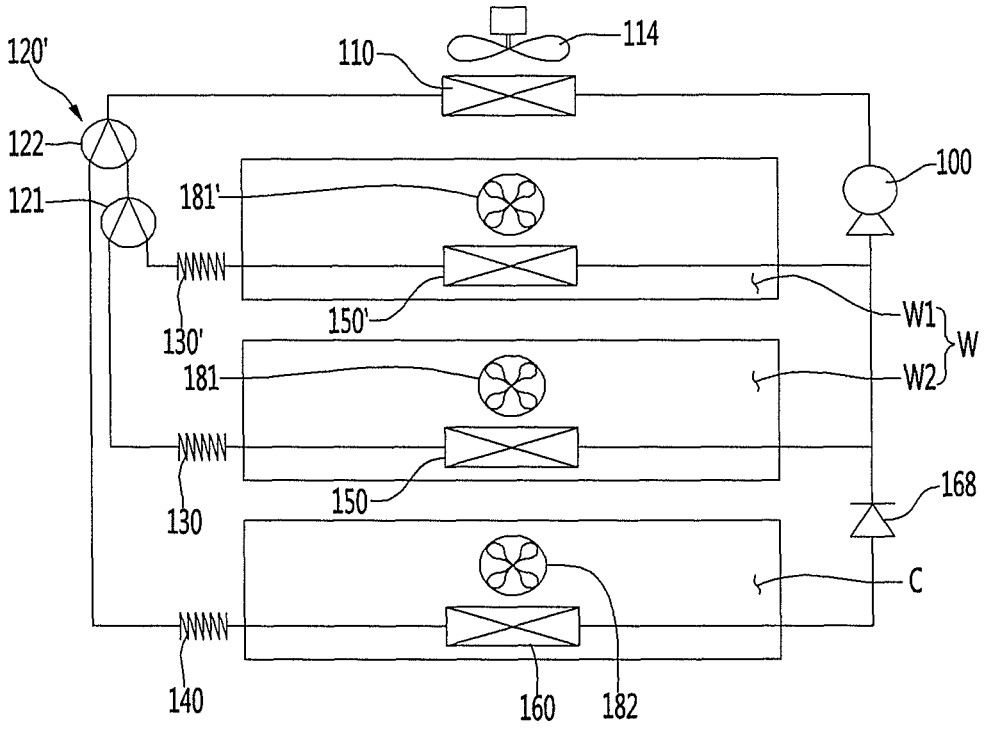
FIGS. 5 to 8 are views illustrating examples of a refrigeration cycle of a refrigerator according to an embodiment of the present disclosure.
Figure 6:
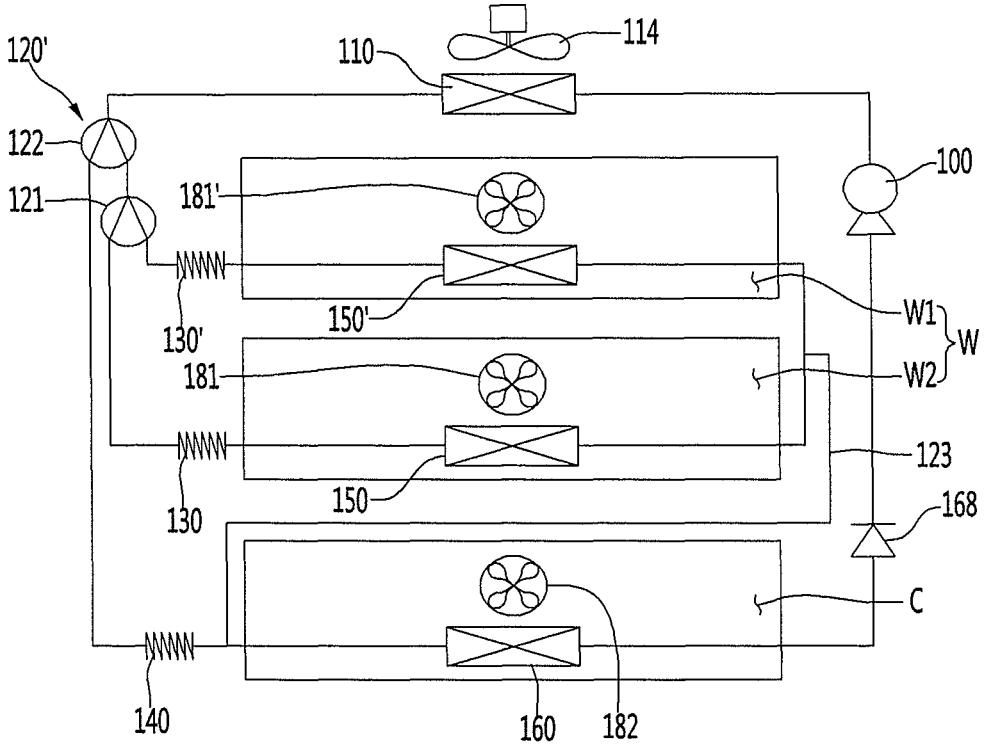
Figure 7:
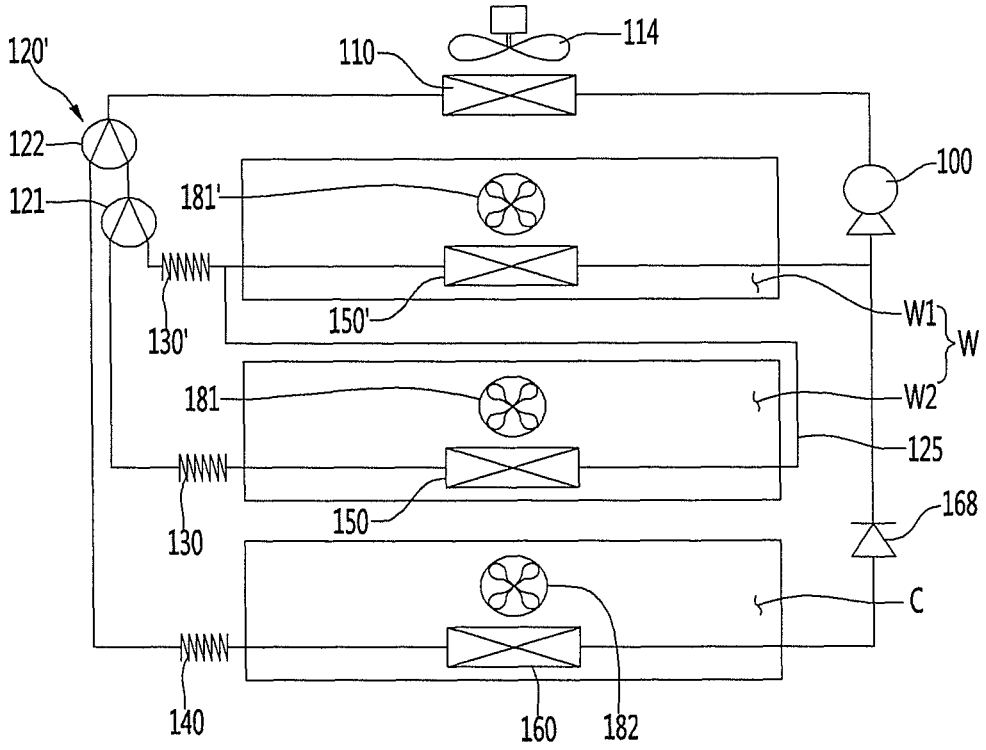

The refrigeration cycle illustrated in FIGS. 5 to 7 may include a compressor 100, a condenser 110, a plurality of expansion mechanisms or devices 130',130, 140, and a plurality of evaporators 150',150, 160 and may further include a flow path switching mechanism (or four way valve) 120'. A case where the first region is the first space W1, the second region is the second space W2, and the third region is the second storage chamber C will be described below. The first, second, and third regions are also applicable to cases ii) and iii) described above.

The plurality of evaporators 150',150, 160 may include a pair of first evaporators 150',150 capable of independently cooling the first space W1 and the second space W2, respectively, and a second evaporator 160 that can cool a second storage chamber C. One of the pair of first evaporators 150' and 150 may be an evaporator 150' cooling the first space W1, and the other of the pair of first evaporators 150' and 150 may be an evaporator 150 cooling the second space W2.

The plurality of expansion mechanisms 130',130, and 140 may include a pair of first expansion mechanisms 130' and 130 connected to a pair of first evaporators 150' and 150, and a second expansion mechanism 140 connected to a second evaporator 160. Any one of the pair of first expansion mechanisms 130' and 130 may be an expansion mechanism 130' connected to any one 150' of the pair of first evaporators 150' and 150, and the other of the pair of first expansion mechanisms 130' and 130 may be an expansion mechanism 130 connected to the other one 150 of the pair of first evaporators 150' and 150.

The flow path switching mechanism 120' may include a first valve 121 capable of controlling a refrigerant flowing into the pair of first expansion mechanisms 130' and 130, and a second valve 122 capable of controlling a refrigerant flowing into the first valve 121 and the second expansion mechanism 140. The refrigerator having the refrigeration cycle illustrated in FIGS. 5 to 7 may include a pair of first fans 181' and 181, and a second fan 182 for circulating cold air in the space of the second storage chamber C to the space of the second evaporator 160 and the second storage chamber C and may further include a condensation fan 114 for blowing outside air to the condenser 110.

Any one of the pair of first fans 181' and 181 may be a fan in the first space in which cold air in the first space W1 can be circulated into any one 150' of the pair of first evaporators 150' and 150 and the first space W1. The other one of the pair of fans 181' and 181 may be a fan in the second space in which cold air in the second space W2 can be circulated into any one 150 of the pair of first evaporators 150' and 150 and the second space W2. The refrigeration cycle illustrated in FIG. 5 may include a first parallel flow path in which a pair of first evaporators 150' and 150 are connected in parallel and a second parallel flow path in which a pair of first evaporators 150' and 150 are connected to the second evaporator 160 in parallel. In this case, a one-way valve 168 may be installed at an outlet side of the second evaporator 160 to prevent the refrigerant at the outlet side of the first evaporators 150 and 150' from flowing back to the second evaporator 160.

The refrigeration cycle illustrated in FIG. 6 may include a parallel flow path in which a pair of first evaporators 150' and 150 are connected in parallel and a serial flow path 123 in which the pair of first evaporators 150' and 150 are connected to a second evaporator 160 in series. One end of the serial flow path 123 may be connected to a parallel flow path in which a pair of first evaporators 150' and 150 are connected in parallel. The other end of the serial flow path 123 may be connected between the second expansion mechanism 140 and the inlet of the second evaporator 160. In this case, a one-way valve 168 may be installed at the outlet side of the second evaporator 150 to prevent the refrigerant at the outlet side of the second evaporator 150 from flowing back to the second evaporator 150.

The refrigeration cycle illustrated in FIG. 7 may include a serial flow path 125 in which a pair of first evaporators 150' and 150 are connected in series, and, a parallel flow path in which the pair of first evaporators 150' and 150 are connected to the second evaporator 160 in parallel. One end of the serial flow path 125 may be connected to the outlet side of any one 150 of the pair of first evaporators 150' and 150. The other end of the serial flow path 125 may be connected to an inlet side of the other 150' of the pair of first evaporators 150' and 150'. In this case, a one-way valve 168 may be installed at the outlet side of the second evaporator 160 to prevent the refrigerant at the outlet side of the second evaporator 160 from flowing back to the second evaporator 160.

Figure 8:
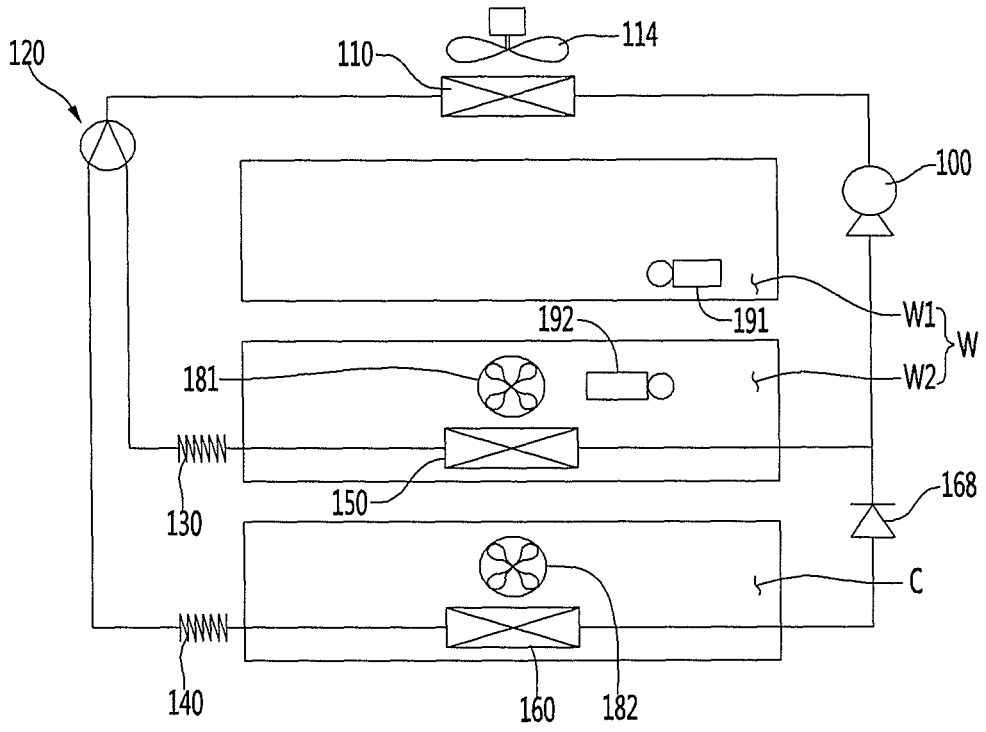

The refrigeration cycle illustrated in FIG. 8 may include one first evaporator 150 instead of the pair of first evaporators 150' and 150 illustrated in FIGS. 5 to 7, and one first expansion mechanism 130 instead of the pair of expansion mechanism 130' and 130. In addition, the refrigeration cycle illustrated in FIG. 8 may include a flow path switching mechanism 120 for controlling the refrigerant flowing into the first expansion mechanism 130 and the second expansion mechanism 140, and the flow path switching mechanism 120 may include a refrigerant valve that can be switched so that the refrigerant flowing from the condenser 110 flows to the first expansion mechanism 130 or the second expansion mechanism 140. In addition, a one-way valve 168 may be installed at the outlet side of the second evaporator 160 to prevent the refrigerant at the outlet side of the second evaporator 160 from flowing back to the second evaporator 160. Since other configurations and actions other than one first evaporator 150, one first expansion mechanism 130, a flow path switching mechanism 120, and a one-way valve 168 of the refrigeration cycle illustrated in FIG. 8 are the same as or similar to those of the refrigeration cycle illustrated in FIGS. 5 to 7, a detailed description with respect to those will be omitted.

The refrigerator having a refrigeration cycle illustrated in FIG. 8 may include a first fan 181 circulating cold air of the first storage chamber W into the first evaporator 150 and the first storage chamber W instead of the pair of first fans 181' and 181 illustrated in FIGS. 5 to 7. In addition, the refrigerator having the refrigeration cycle illustrated in FIG. 8 may include a first damper 191 for controlling cold air flowing into the first space W1 after being cooled by the first evaporator 150 and a second damper 192 for controlling the cold air flowing into the second space W2 after being cooled by the first evaporator 150. Only one of the first damper 191 and the second damper 192 may be provided. In the refrigerator, one damper may selectively supply air cooled by the evaporator 150 to at least one of the first space W1 and the second space W2.

Modification examples of the refrigeration cycle illustrated in FIGS. 5 to 8 may be applied to a refrigerator having two spaces having different storage temperature ranges from each other. For example, the modification examples of the refrigeration cycle may be applied to a refrigerator having a first space W1 and a second space W2 or a refrigerator having a first storage chamber W and a second storage chamber C. The refrigeration cycle may be configured with a cycle which does not include the flow path switching mechanisms 120 and 122, the second expansion mechanism 140, the second evaporator 160, the second fan 182, and the one-way valve 168.

Figure 9:
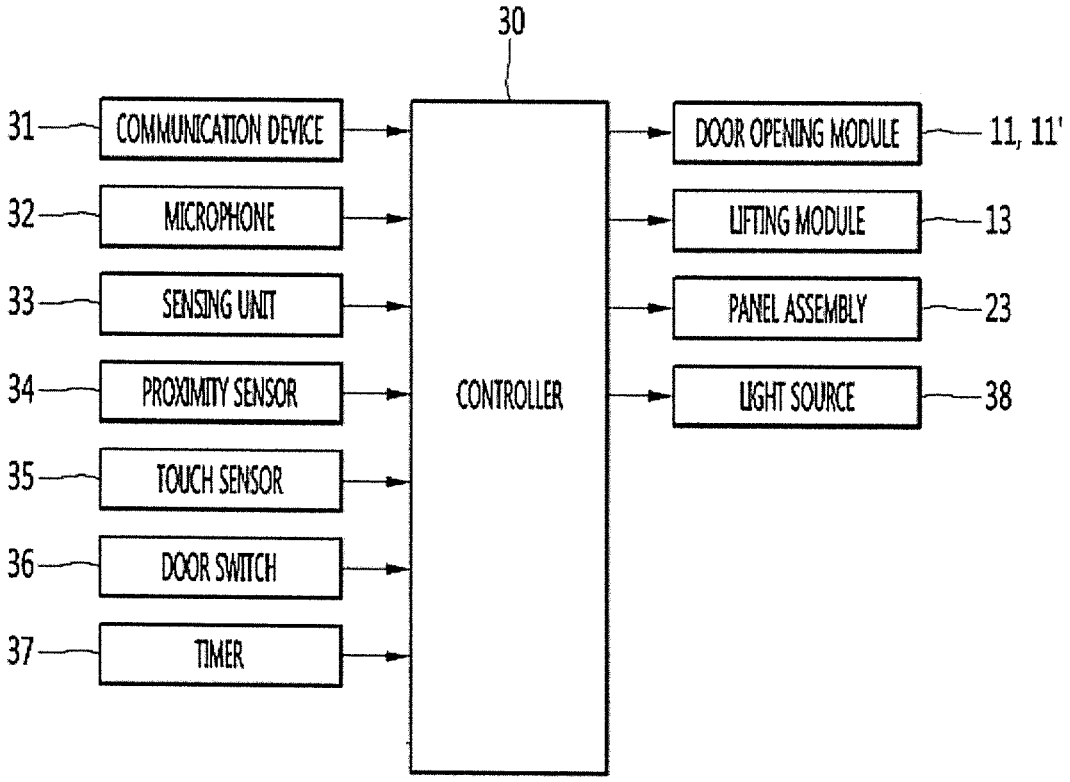
FIG. 9 is a control block diagram of a refrigerator according to an embodiment of the present disclosure.

Referring to FIG. 9, the refrigerator may include a controller 30 that controls various electronic devices such as a motor provided in the refrigerator. The controller 30 may control the refrigerator according to the input value of the input device. The input device may include at least one of a communication device 31 which receives a signal from an external device such as a remote controller such as a remote controller or a mobile terminal such as a mobile phone, a microphone 32 that changes a user's voice to a sound signal, a sensing unit 33 which can sense a user's motion, a proximity sensor 34 (or a distance sensor) which can sense the user's proximity, a touch sensor 35 which can sense the user's touch, a door switch 36 which can detect the opening and closing of the door, and a timer 37 which can measure the lapse of time.

The see-through door may be a door which may alternate between a see through or transparent (see-through activation state) and an opaque (see-through deactivation state) state. The see-through door may be a door that is changed from an opaque state to a see-through state according to an input value provided to the controller 30 through the input device. The see-through door may be a door that is changed from a see-through state to an opaque state according to an input value provided to the controller 30 through the input device. The see-through door may be a door in which the see-through door is changed from an opaque state to see-through state, in a state where the see-through door is closed, according to an input value provided to the controller 30 through the input device.

The sensing unit (or sensor) 33 may be a vibration sensor provided on the rear surface of the front panel, the vibration sensor may be formed in black, and visible exposure may be minimized. The sensing unit 33 may be a microphone provided on the rear surface of the front panel, and the microphone may sense sound waves of vibration applied to the front panel. When a user taps the panel assembly 23 a plurality of times at a predetermined time interval is detected through the sensing unit 33, the user may change the see-through door to be activated or deactivated.

The sensing unit 33 may be a device for imaging a user's motion, or a camera. It may be determined whether the image photographed by the sensing unit 33 is similar or identical to a specific motion input in advance, and may be changed to activate or deactivate the see-through door according to the determination result. If the sensor senses that the user is close to a predetermined distance or more according to the value detected by the proximity sensor 34, the see-through door may be changed to be activated or deactivated. When the sensor senses that the door is closed according to the value detected by the door switch 36, the see-through door may be activated, and when the sensor senses that the door is open, the see-through door may be changed to be inactivated.

The see-through door may be controlled to be deactivated after a certain time elapses after being activated according to the value input through the timer 37. According to the value input through the timer 37, the see-through door may be controlled to be activated when a predetermined time elapses after being deactivated.

If the device for activating or deactivating the see-through door is defined as a transparency control module, for example, the panel assembly 23 and a light source 38 may be used. As an example in which the see-through door is activated or deactivated, there may be a case where the transparency of the see-through door itself may vary. For example, the see-through door may maintain in an opaque state when no current is applied to the panel assembly 23 and may be changed to be transparent when current is applied to the panel assembly 23. In another example, when the light source 38 installed inside the see-through door is turned on, the user may see the storage chamber through the see-through door by the light emitted from the light source 38.

The light source 38 may make the panel assembly 23 appear transparent or translucent so that an inside of the refrigerator (a side of the storage chamber relative to the panel assembly) looks brighter than outside of the refrigerator (outside relative to the panel assembly). The light source 38 may be mounted on the light source mounting portion formed on the cabinet 1 or the light source mounting portion formed on the door and may be disposed to emit light toward the panel assembly 23.

The controller 30 may control the door opening module 11 according to the input value of the input device. The controller 30 may control the lifting module 13 according to the input value of the input device.

Figure 10:
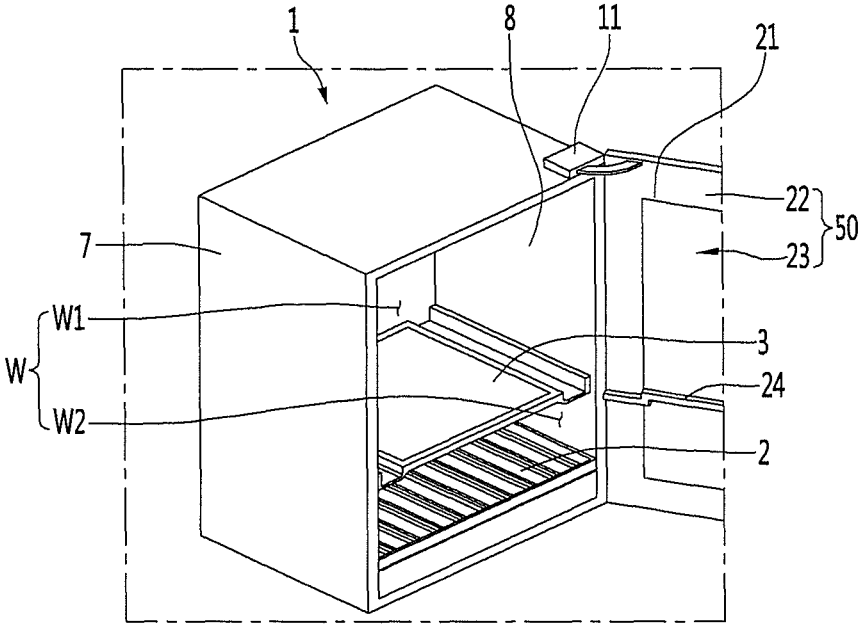
FIG. 10 is a perspective view illustrating a see-through door of a refrigerator according to an embodiment of the present disclosure.

Referring to FIG. 10, the refrigerator may include a door (hereinafter, a see-through of transparent door) through which a user may view into the storage chamber through a see-through window without opening the door 50 from the outside of the refrigerator. The see-through door may include an outer door 22 and a panel assembly 23.

The outer door 22 may be opaque and an opening portion 21 may be formed. The outer door 22 may form an outer appearance of the see-through door. The outer door 22 may be rotatably connected to or connected to the cabinet 1 to be capable of being advanced and retracted. The panel assembly 23 may be arranged in the opening portion 21. The panel assembly 23 may shield the opening portion 21. The panel assembly 23 may form the same outer appearance as the front surface of the outer door 22.

The see-through door may open and close the storage chamber which mainly stores goods (for example, wine) having a large quality change according to the temperature change. In a case where goods having a large quality change due to temperature change are mainly stored in the storage chamber W, the storage chamber W may be opened and closed as short as possible, the number of opening and closing actions is preferably minimized, and the see-through door may open and close the storage chamber W. For example, the see-through door may be provided in the door for opening and closing at least one of the specific goods storage chamber, the constant temperature chamber, and the priority storage chamber.

Figure 11:
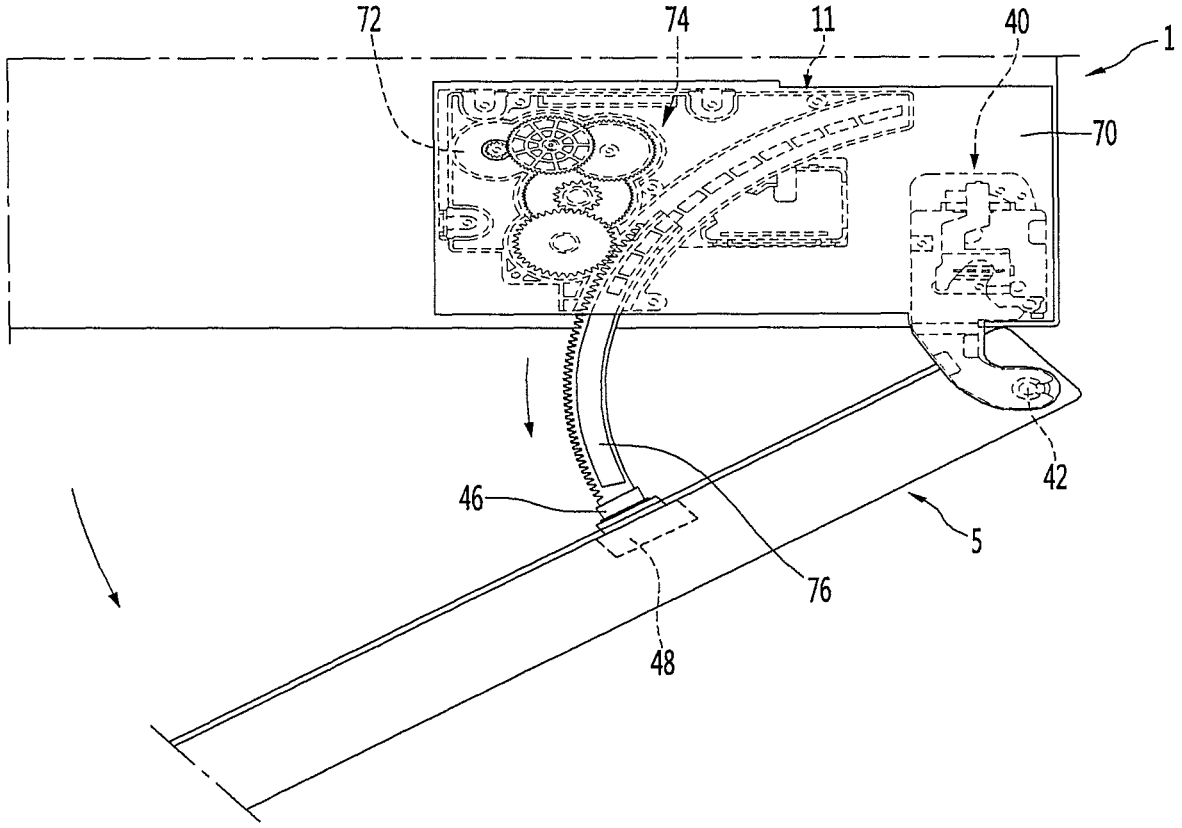
FIG. 11 is a plan view when an example of a door according to an embodiment of the present disclosure is opened in a door opening module.

Referring to FIG. 11, in the refrigerator, a door opening and closing the storage chamber may be an automatic door, and the door for opening and closing the specific goods storage chamber, the constant temperature chamber, and a priority storage chamber may be an automatic door. The refrigerator may include a door opening module 11 for forcibly opening the door 5. The automatic door may be controlled to be opened or closed according to an input value provided to the controller 30 through the input device. For this purpose, the controller 30 may control the door opening module 11.

The cabinet 1 may be installed with a hinge mechanism 40 in which the hinge shaft 42 is connected to the door 5. The refrigerator may further include a module cover 70 that may cover the hinge mechanism 40 and the door opening module 11 together. In addition, the door opening module 11 may include a drive motor 72, a power transmission unit 74, and a push member or lever 76.

When the power of the refrigerator is turned on, the controller 30 may wait to receive an open command of the door 5. When the door opening command is input through the input device, the controller 30 may transmit an opening signal to the drive motor 72 included in the door opening module 11.

When the controller 30 transmits an opening signal to the drive motor 72, the drive motor 72 may be rotated in a first direction to move the push member 76 from an initial position to a door opening position. When the drive motor 72 rotates in the first direction, the power transmission unit 74 may transmit a first direction rotational force of the drive motor 72 to the push member 76, the push member 76 may push the door while protruding forward, and the door 5 may be rotated in the forward direction with respect to the cabinet 1.

The controller 30 may determine whether the push member 76 has reached the door opening position in a process of rotating in the first direction of the drive motor 72. For example, the controller may determine that the push member 76 has reached the door opening position when the cumulative rotational speed of the drive motor 72 reaches a reference rotational speed. The controller 30 may stop the rotation of the drive motor 72 when it is determined that the push member 76 has moved to the door opening position.

In a state where the door 5 is rotated through a predetermined angle, the user may manually increase the opening angle of the door 5. When the user increases the opening angle of the door in a state where the push member 76 moves the door 5 to the door opening position, the door sensor including a magnet 46 and a reed switch 48 may sense the manual opening of the door 5, and if the manual opening of the door 5 is sensed by the door sensor, the controller 300 may output a return signal to the drive motor 72.

The controller 30 may transmit the return signal to the drive motor 72 so that the push member 76 returns to the initial position and the drive motor 72 may be reversely rotated in a second direction opposite to the first direction. When the push member 76 has returned to the initial position, the controller 30 may stop the drive motor 72.

Figure 12:
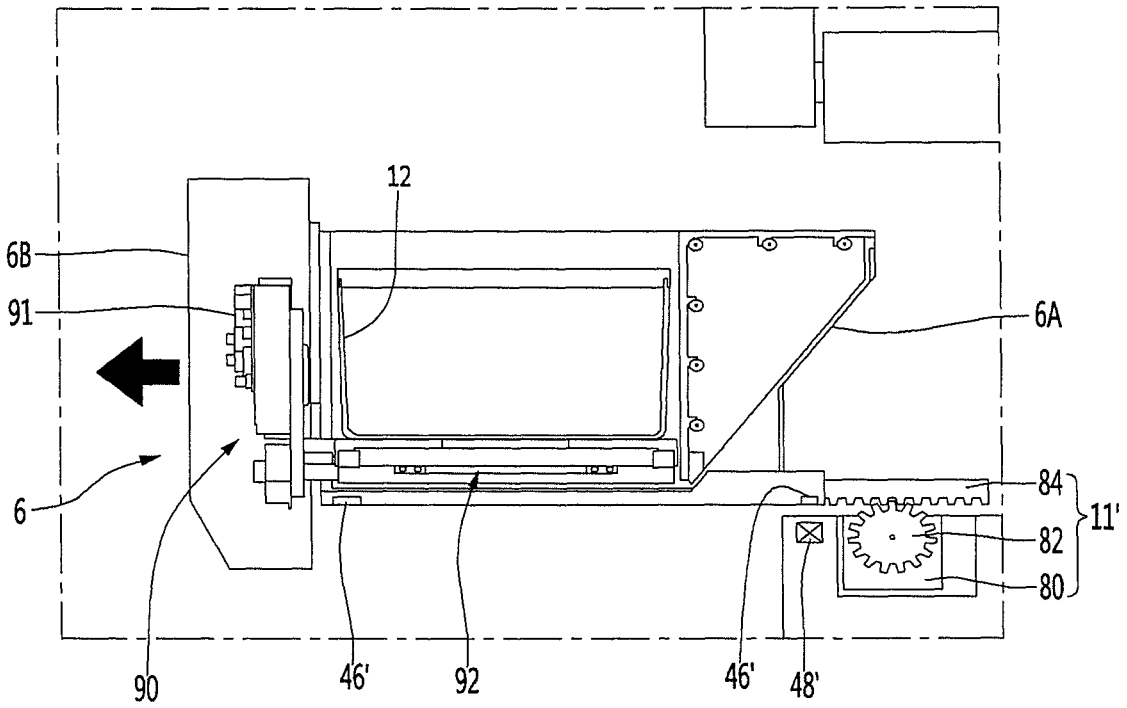
FIG. 12 is a cross-sectional view when another example of a door according to an embodiment of the present disclosure is opened by the door opening module.

The door opening module 11' illustrated in FIG. 12 may automatically open the door 6 disposed in the cabinet 1 to be capable of being advanced and retracted. The refrigerator may include a door having a high height and a door having low height, and the door opening module 11' may be installed to automatically open a door having a lower height than other doors. Such a door may be a retractable automatic door which is automatically opened by the door opening module 11'.

The door 6 advanced and retracted by the door opening module 11' may include a drawer body 6A and a door body 6B disposed at the drawer body 6A to open and close the storage chamber. The door opening module 11' may include a drive motor 80, a pinion 82, and a rack 84. The pinion 82 may be connected to the rotation shaft of the drive motor 80. The rack 84 may extend from the door 6. For example, the drawer body 6A.

The refrigerator may further include a door sensor that senses a position of the door 6, and the door sensor may sense a pair of magnets 46' spaced apart from the door 6 and a reed switch 48' sensing the magnet 46'. When the power of the refrigerator is turned on, the controller 30 may wait to receive an opening command of the door 6. When the door opening command is input through the input device, the controller 30 may transmit an opening signal to the drive motor 80.

The drive motor 80 may be rotated in the first direction by the controller 30 when an opening signal is input, and the pinion 82 and the rack 84 may transmit the rotational force of the drive motor 80 to the drawer body 82, the drawer body 6A may advance the door body 6B while advancing forward in the storage chamber, and the door body 6B may be advanced to be spaced apart from the cabinet 1 toward the front of the cabinet 1. The controller 30 may sense that the door 6 has reached the opening position by the door sensor, and when the door 6 has reached the opening position, the controller 30 may stop the rotation of the drive motor 80.

When the drawer body 6A is advanced as described above, the upper surface of the drawer body 6A may be exposed. In a state where the drawer body 6A is advanced to the opening position, the user may enter a door closing command such that the drawer body 6A retracts to the closing position via the input device. For example, if the motion sensed by the sensing unit 33 coincides with a specific motion, the controller 30 may transmit a close signal to the drive motor 80. The controller 30 may sense the proximity of the user by the proximity sensor 34, and transmit a closing signal to the drive motor 80 when the proximity sensor 34 detects that the user has moved more than a predetermined distance.

When the close signal is input, the drive motor 80 may be reversely rotated in a second direction opposite to the first direction. In reverse rotation of the drive motor 80, the pinion 82 and the rack 84 may transmit the rotational force of the drive motor 80 to the drawer body 6A, and while the drawer body 6A retracts into the storage chamber, the door body 6B may be retracted and the door body 6B may be retracted in close contact with the cabinet 1 toward the front of the cabinet 1. The controller 30 may sense that the door 6 has reached the closing position by the door sensor, and if the door 6 has reached the closing position, the controller 30 may stop the rotation of the drive motor 80.

Figure 13:
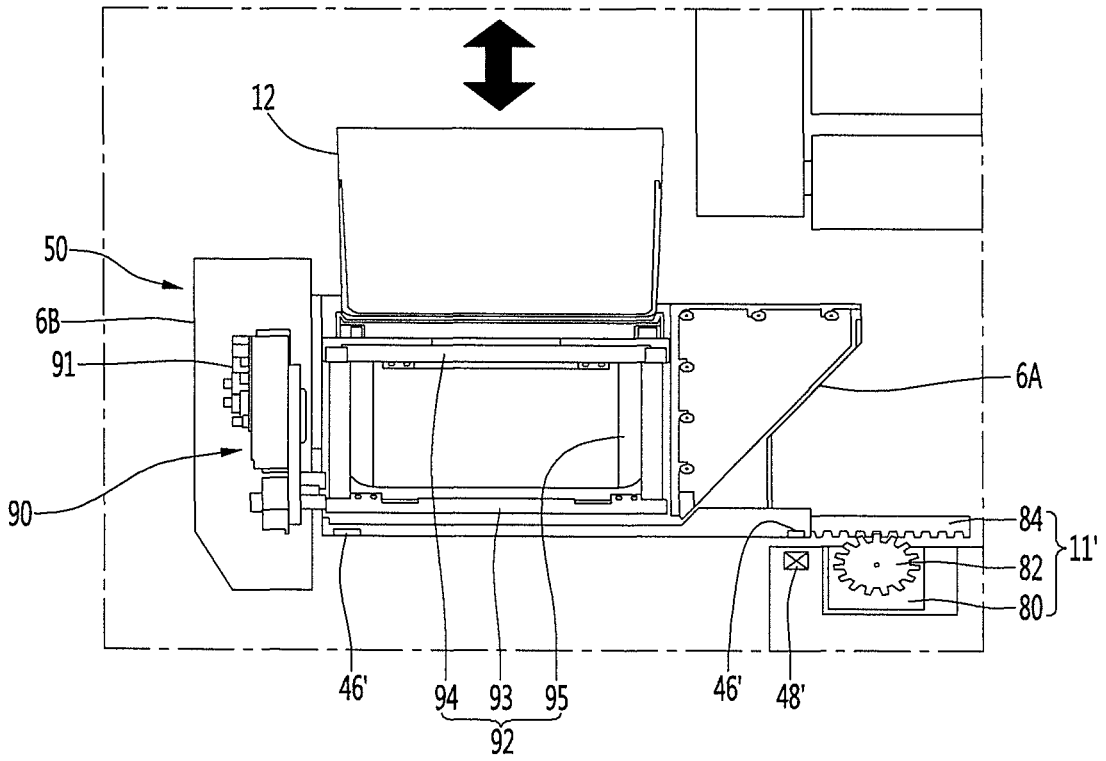
FIG. 13 is a sectional view when a holder illustrated in FIG. 12 is lifted.
Figure 14:
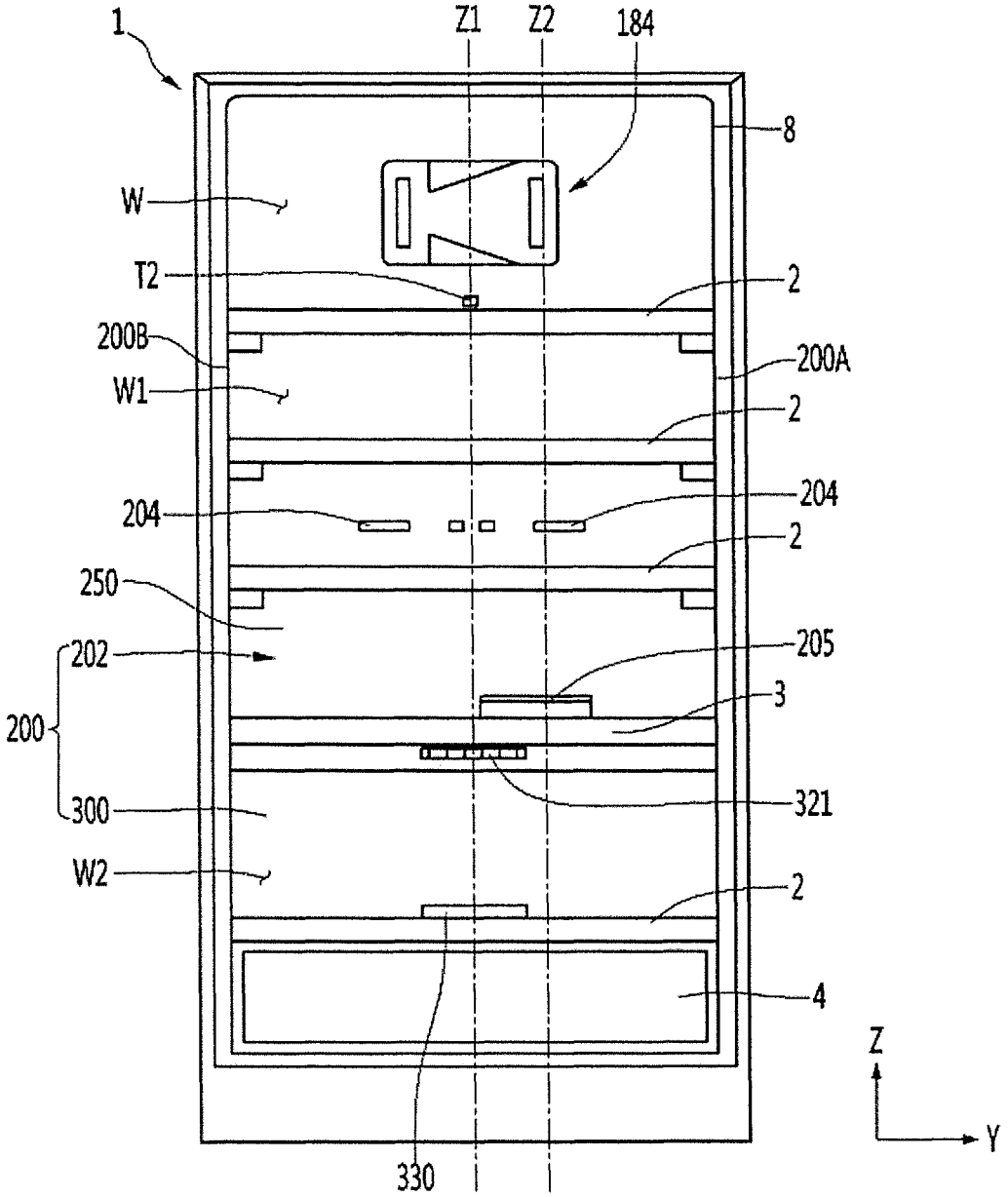
FIG. 14 is a front view illustrating a storage chamber of an example of a refrigerator according to an embodiment of the present disclosure.
Figure 15:
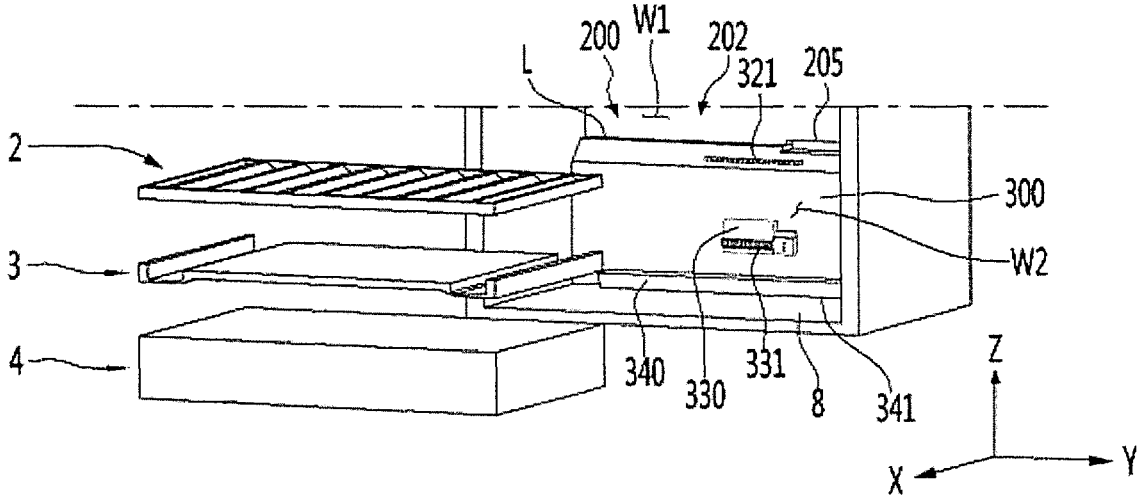
FIG. 15 is a perspective view illustrating when the partition member, the shelf, and the storage member according to the embodiment of the present disclosure are separated in front of the storage space.
Figure 16:
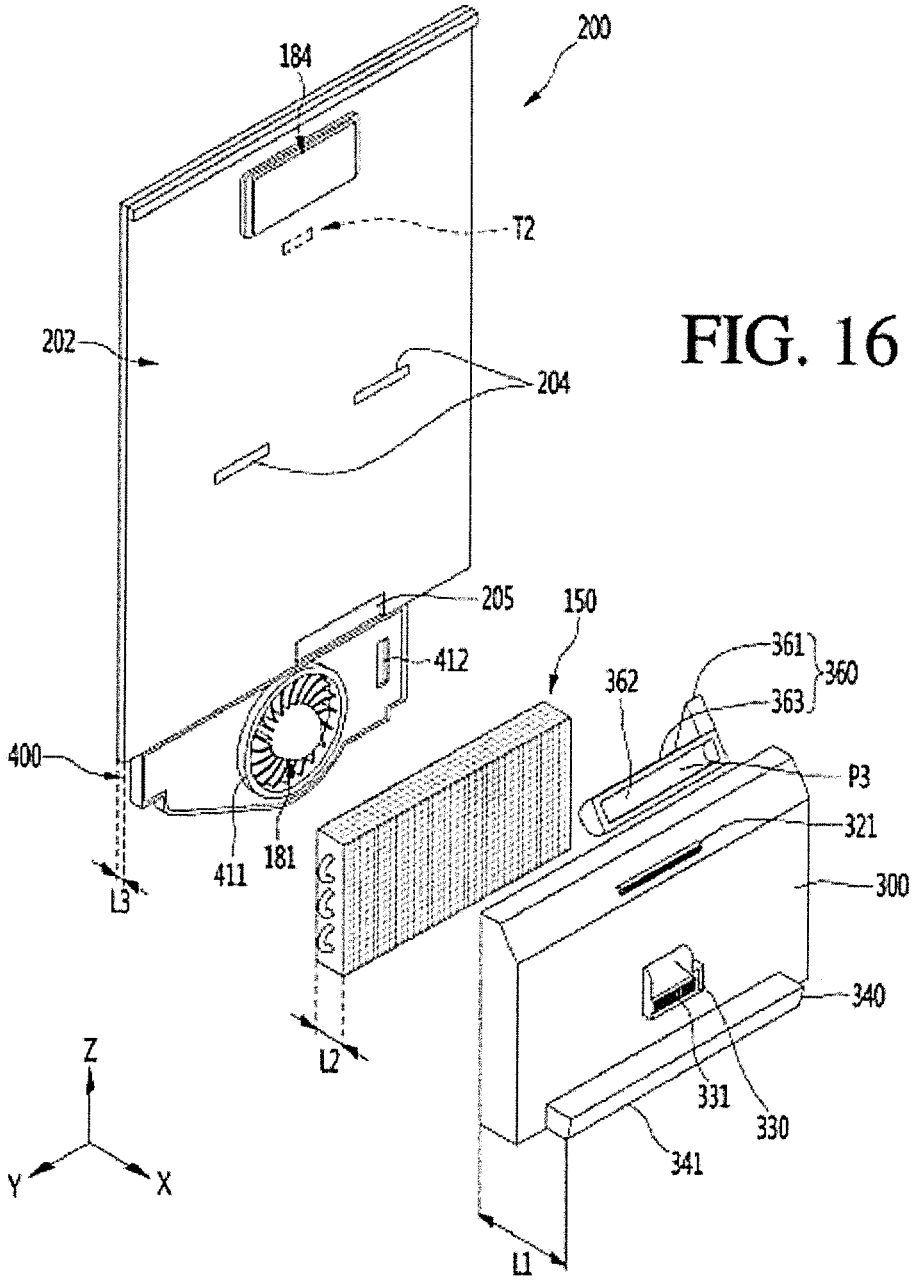
FIG. 16 is an exploded perspective view illustrating an inner guide and an evaporator according to an embodiment of the present disclosure.
Figure 17:
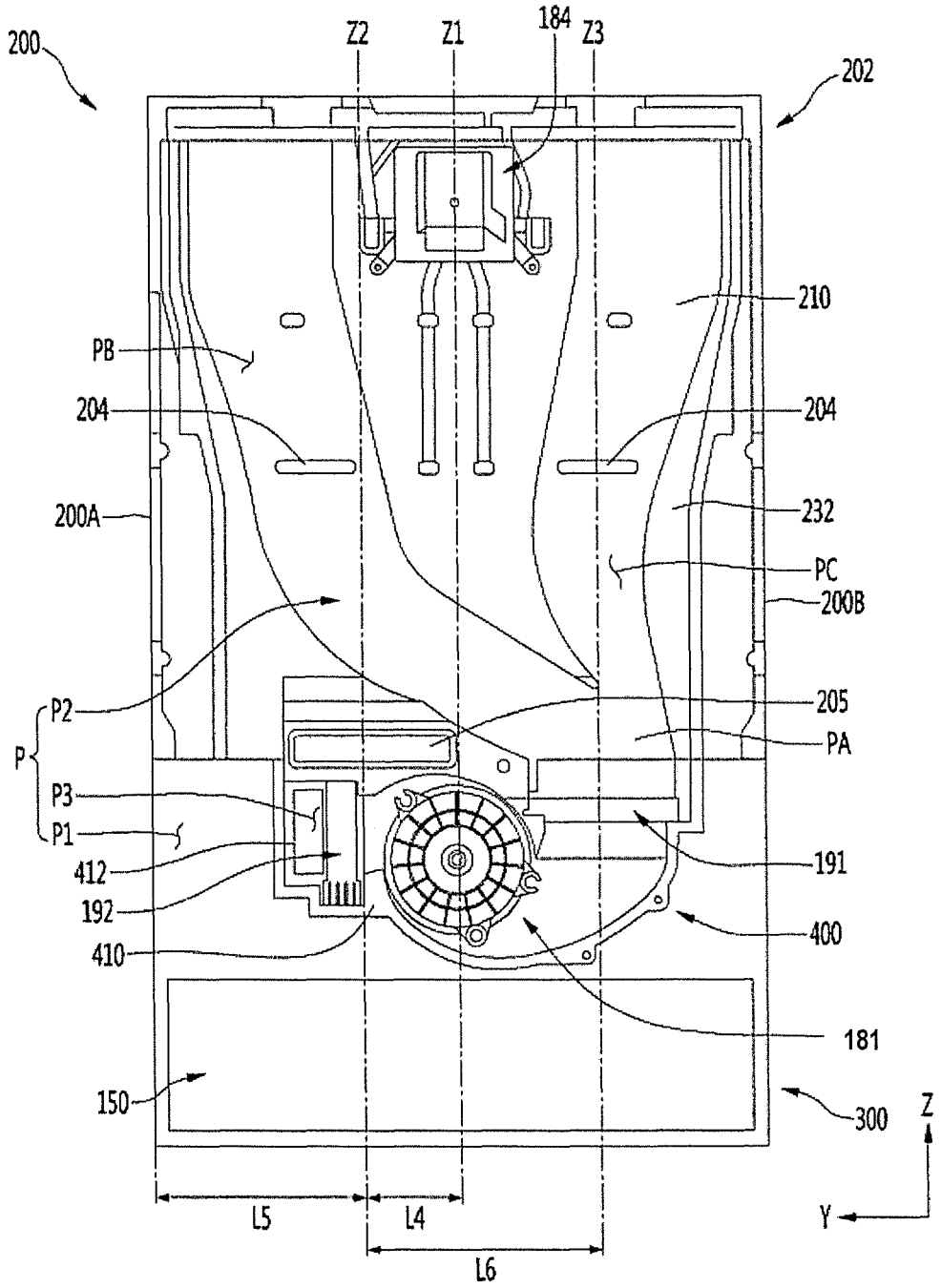
FIG. 17 is a rear view illustrating an inner portion of the inner guide according to an embodiment of the present disclosure.
Figure 18:
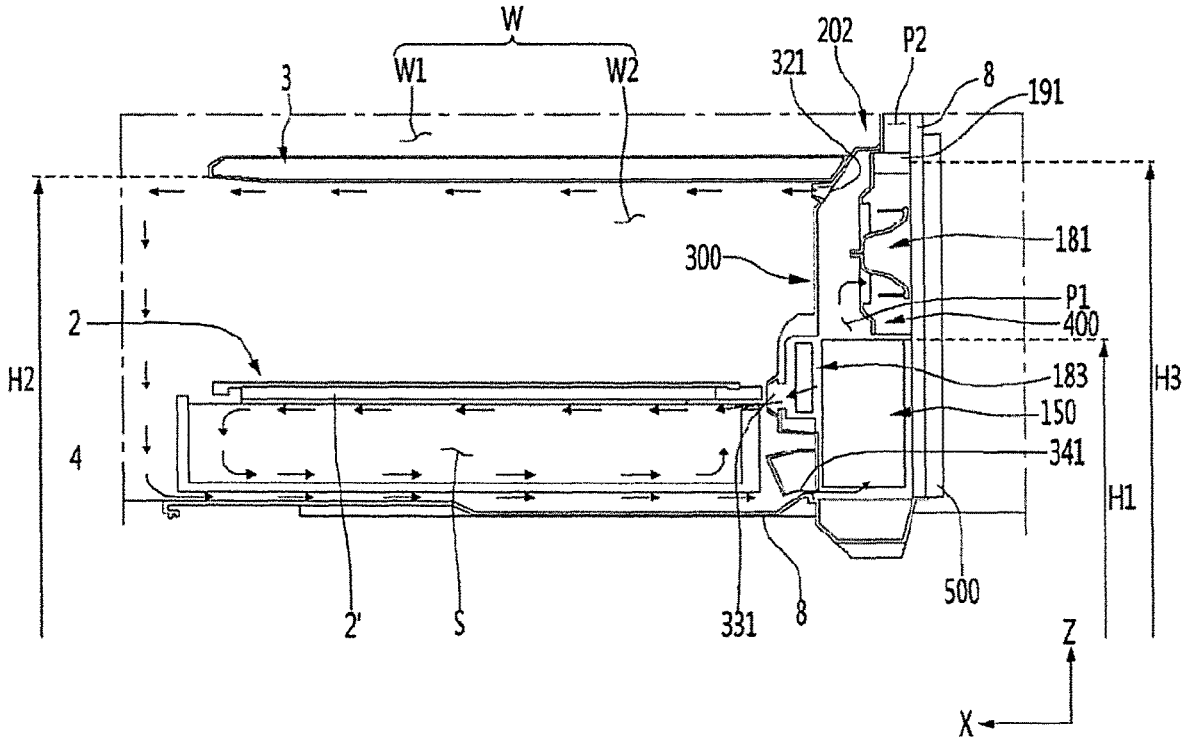
FIG. 18 is a sectional view illustrating when the air is discharged to the second space and the storage space, as an example of a refrigerator according to an embodiment of the present disclosure.
Figure 19:
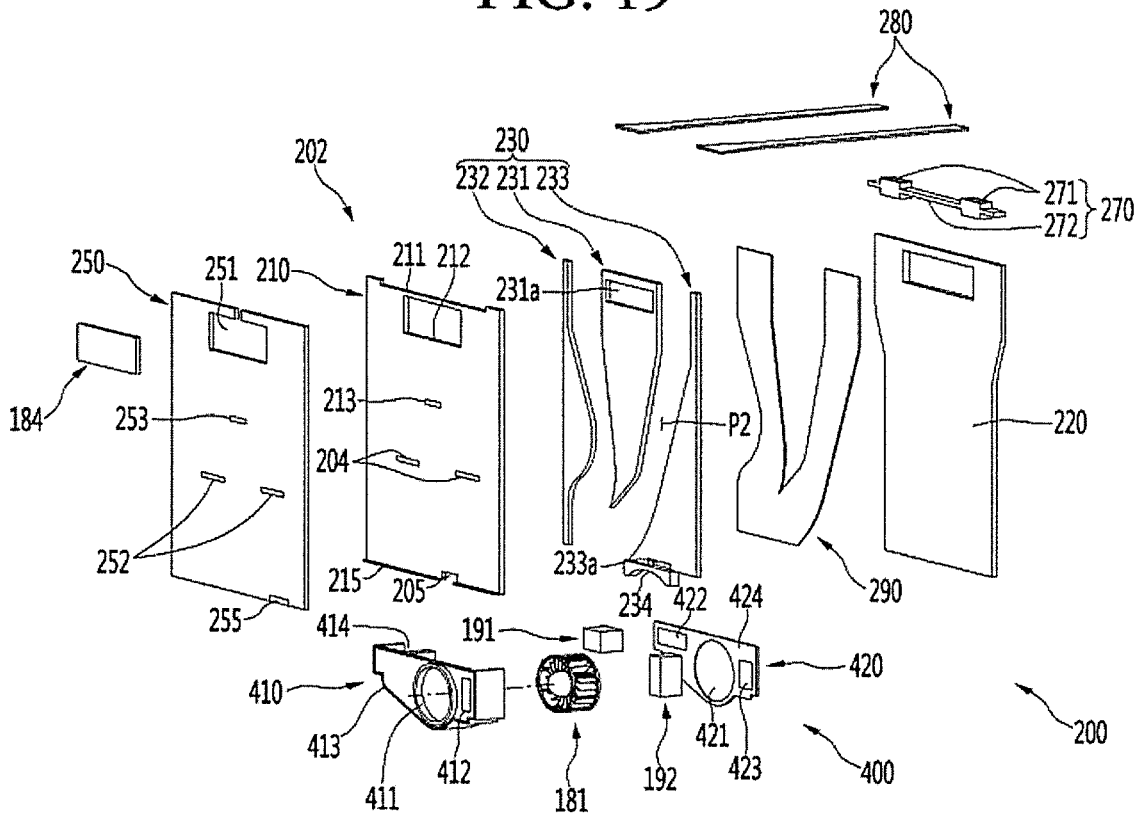
FIG. 19 is an exploded perspective view illustrating a discharge guide and an air guide according to an embodiment of the present disclosure.
Figure 20:
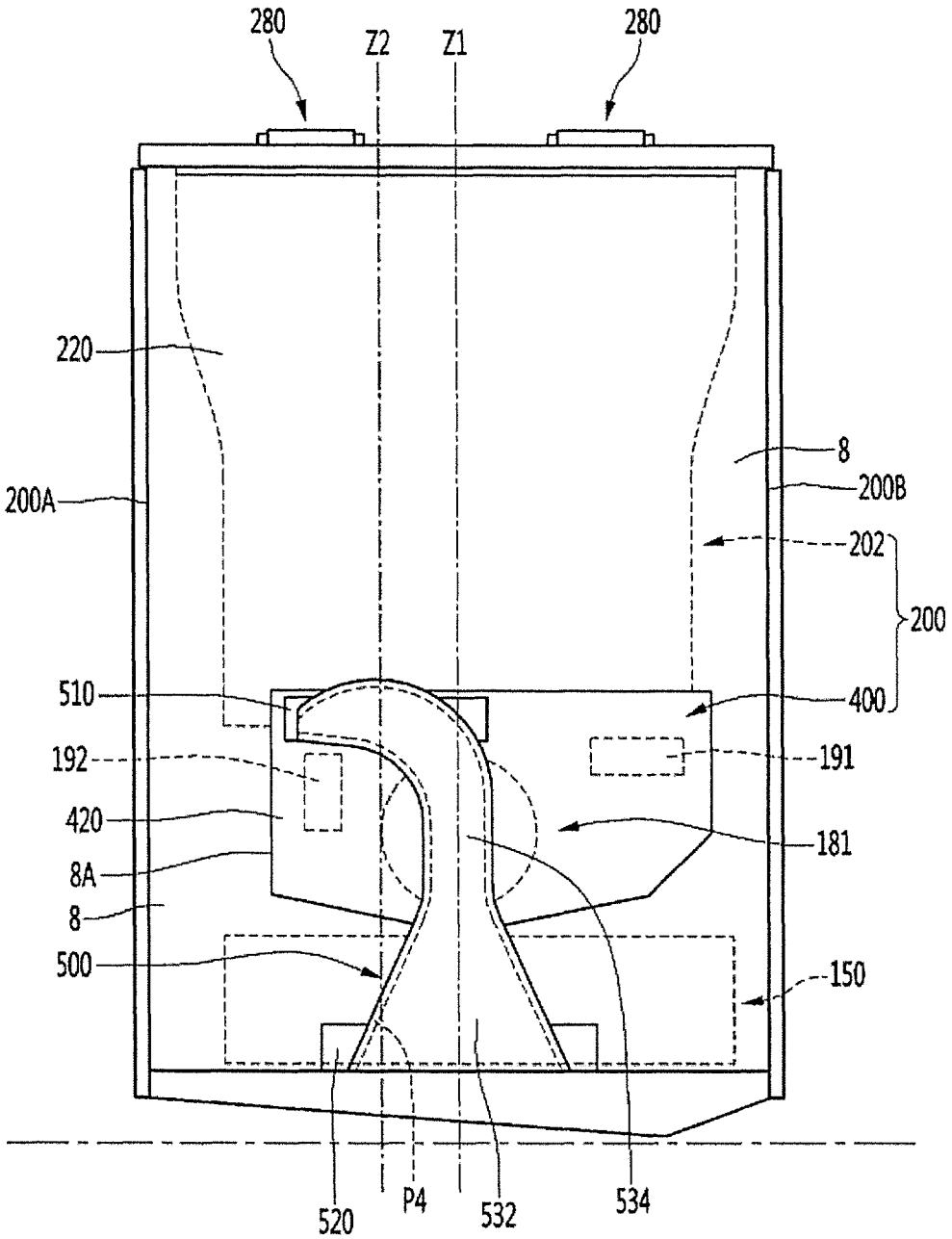
FIG. 20 is a rear view illustrating a return duct according to an embodiment of the present disclosure.
Figure 21:
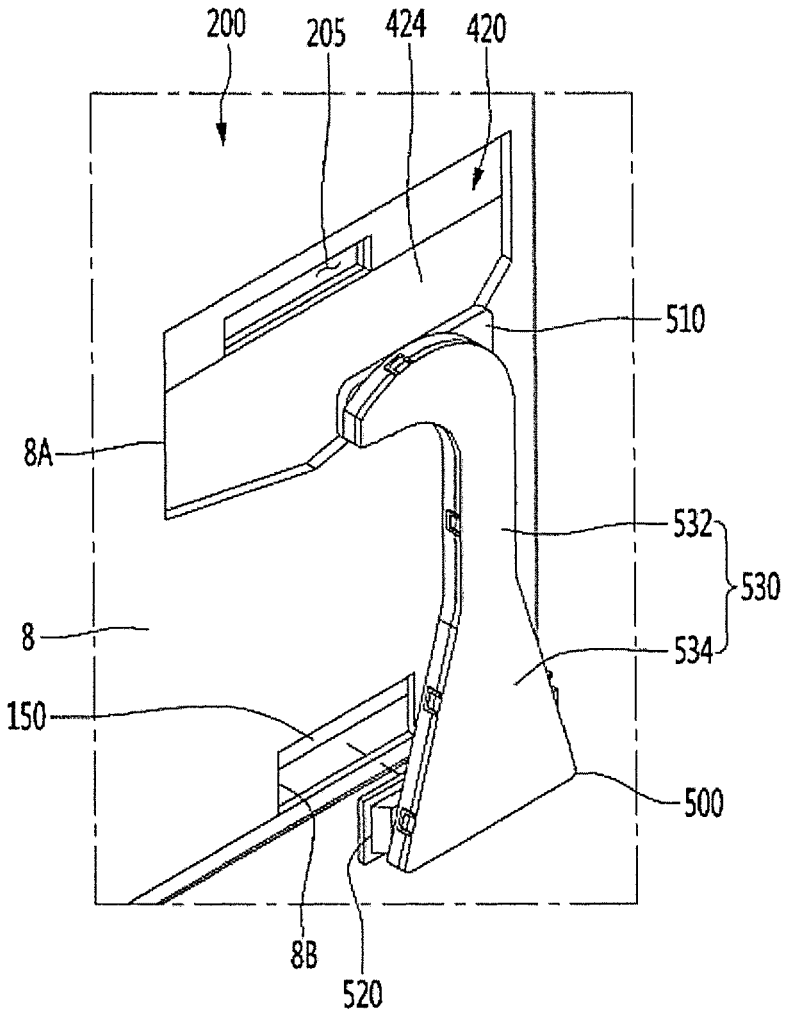
FIG. 21 is a perspective view when the return duct illustrated in FIG. 20 is separated from the inner guide.

Referring to FIG. 13, the refrigerator may further include a lifting module 13 which allows the holder 12 to be automatically lifted and lowered after the holder 12 is moved forward in a state where the door 50 is opened. The holder 12 may be a shelf, a drawer, a basket, or the like on which goods can be placed. The lifting module 13 may be provided in the storage chamber or at least one of the rotatable door 5 and the advancing and retracting type door 6 for opening and closing the storage chamber. The refrigerator may have both a holder having a high height and a holder having a low height.

The lifting module may be provided in a storage chamber in which a holder having a lower height than other holders is located. The lifting module for lowering may be arranged in a storage chamber in which a holder having a relatively higher height than other holders is located.

The lifting module 13 may include a lower frame 93, an upper frame 94, an lifting and lowering mechanism 92 having at least one link 95, and a drive mechanism 90 capable of lifting and lowering the upper frame 94. The drive mechanism 90 may include a lifting and lowering motor 91 and a power transmission member connected to the lifting and lowering motor 91 to transfer the drive force of the lifting and lowering motor 91 to the upper frame 94.

When the power of the refrigerator is turned on, the controller 30 may wait for a lifting command of the holder 12 to be input. When the lifting command is input through the input device, the controller 30 may transmit a lifting signal to the lifting and lowering motor 91 included in the lifting module 13. When the controller 30 transmits an opening signal to the lifting and lowering motor 91, the upper frame 94 may lift, and the holder 12 may be lifted to the upper side of the drawer body 6B.

The user may input a lowering command through the input device, and the controller 30 may transmit a lowering signal to the lifting and lowering motor 91 when the lowering command is input through the input device. The lifting and lowering motor 91 may be reversely rotated in a second direction opposite to the first direction. Upon reverse rotation of the lifting and lowering motor 91, the upper frame 94 may be lowered to the inner lower portion of the drawer body 82, and the holder 12 may be inserted into the drawer body 6B together with the upper frame 94.

Referring to FIGS. 14-21, hereinafter, although the temperature adjusting device provided in the air flow path P will be described as an example of a cooling device, the temperature adjusting device provided in the air flow path P is not limited to being a cooling device, but may be a heating device such as a heater. For convenience, the temperature control device provided in the air flow path P will be described with the same reference numeral 150 as the evaporator, which can be an example. Hereinafter, the airflow forming mechanism disposed in the air flow path P will be described as the fan 181.

When the storage chamber W is opened, the front surface of the inner guide 200 may face the front of the storage chamber W. The inner guide 200 may be formed so that its front surface is as close to the plane as possible. The inner guide 200 may have a portion (that is, a bent portion) that is bent at another portion of the periphery or a portion (that is, a protrusion portion) that protrudes more than the other portion of the periphery.

When the inner guide 200 is a combination of a plurality of members, the boundary L of the plurality of members or the coupling portion of the plurality of members may be positioned at the rear or the side of another structure (for example, the shelf 2, the partition member 3, receiving member 4, or the like) disposed inside the storage chamber W, and thus may be concealed by the other configuration or located close to the other configuration. When the boundary L or the coupling portion is minimized, the outer appearance of the inner guide 200 may be simplified, and the refrigerator may be advanced.

The inner guide 200 may function as a discharge duct for discharging air into the storage chamber W and may function as a suction duct for returning the air in the storage chamber W to the temperature adjusting device 150. The inner guide 200 may have a discharge port 204 and a suction port 205, and the discharge hole 204 and the suction port 205 may be spaced apart from the inner guide 200. When the suction port is not visible as much as possible in front of the storage chamber W as described above, the outer appearance of the inner guide 200 may be more concise, and the refrigerator may be more aesthetically pleasing.

The refrigerator may further include a partition member 3 disposed in the storage space to partition the storage space into a first space W1 and a second space W2. The partition member 3 may be closer to the lower end of the upper and lower ends of the storage chamber.

In the refrigerator, a discharge port 204 (hereinafter, referred to as a first discharge port) for discharging air into the first space W1 and a suction port 205 (hereinafter, referred to as a first suction port) for suctioning air in the first space W1 may be formed at a position facing the first space W1. In the refrigerator, an additional discharge port 321 (hereinafter, referred to as a second discharge port) for discharging air into the second space W2 and an additional suction port 341 (hereinafter, referred to as a second suction port) for suctioning air in the second space W2 may be formed at a position facing the second space W2. The first discharge port may be at a position higher than the first suction port. The second discharge port may be at a position higher than the second suction port.

One surface of the partition member 3 may function as a suction guide surface for guiding air flowing toward the suction port 205, and the other surface of the partition member 3 may function as a discharge guide surface for guiding air discharged to the additional discharge port 321. The partition member 3 may be spaced apart from the suction port 205 in the horizontal direction and may cover a portion of the suction port 205. At least a portion of the suction port 205 may face the partition member 3 in the horizontal direction.

The gap between the partition member 3 and the suction port 205 may function as an inlet passage through which air in the first space W1 passes to be suctioned into the suction port 205, and the air in the first space W1 may be suctioned to the suction port 205 after passing through the gap between the partition member 3 and the suction port 205. As described above, when a portion of the suction port 205 is covered by the partition member 3, the outer appearance of the suction port 205 may be more advanced than when the entire suction port 205 is visible through the periphery of the partition member 3.

The inner guide 200 may include a heat exchange flow path P1 in which the temperature adjusting device 150 and the fan 181 are received. The inner guide 200 may have a discharge flow path P2 through which air blown by the fan 181 is guided to the discharge port 204. The inner guide 200 may be provided with an additional discharge flow path P3 for guiding the air blown by the fan 181 to be discharged to the additional discharge port 321.

The heat exchange flow path P1, the discharge flow path P2, and the additional discharge flow path P3 may constitute an air flow path P for guiding air to circulate between the temperature adjusting device 150 and the storage space, and the temperature adjusting device 150 and the fan 181 may adjust the temperature of the first space W1 and the second space W2 in a state received in the air flow path P.

The first damper 191 may be provided in the air flow path P and may adjust the air supplied to the first space W1. The first damper 191 may be mounted to the inner guide 200 and may be mounted to be positioned between the fan 181 and the discharge port 204 in the air flow direction.

The second damper 192 may be disposed in the air flow path P and may adjust the air supplied to the second space W2. The second damper 192 may be mounted to the inner guide 200 and may be mounted to be positioned between the fan 181 and the additional discharge port 321 in the air flow direction.

The inner guide 200 may include a discharge port 204 for discharging air into the first space W1, a discharge guide 202 disposed to face the first space W1, an additional discharge port 321 for discharging air to the second space W2, and an inner cover 300 disposed to shield the temperature adjusting device 150, facing the second space W2.

One of the discharge guide 202 and the inner cover 300 may be disposed higher than the other. For example, the width L1 of the inner cover 300 in the front and rear direction may be larger than the width L2 of the temperature adjusting device 150 in the front and rear direction, and the width L3 of the discharge guide 202 in the front and rear direction may be smaller than the width L2 of the temperature adjusting device 150 in the front and rear direction. For example, the width L1 of the inner cover 300 in the front and rear direction may be larger than the width L3 of the discharge guide 202 in the front and rear direction.

In this case, the temperature adjusting device 150 may be closer to the lower end of the upper and lower ends of the storage chamber (W). The fan 181 and the temperature adjusting device 150 may be positioned lower than the upper end of the inner cover 300 and may be received and covered by the inner cover 300. A portion of the inner guide 200 in which the lower end of the discharge guide 202 and the upper end of the inner cover 300 contact each other may be a boundary L between the discharge guide 202 and the inner cover 300.

The inner cover 300 may be connected to the lower end of the discharge guide 202, and the inner cover 300 may have a step with the discharge guide 202. For example, the inner cover 300 may be a portion that protrudes relatively further in the forward direction than the discharge guide 202. The length of the inner cover 300 in the vertical direction Z may be a factor for determining the total volume occupied by the storage space in the storage chamber W. The inner cover 300 may have a length in the vertical direction Z which can receive the fan 181, the temperature adjusting device 150, and the air guide 400, wherein the length in the vertical direction Z is preferably formed as short as possible.

On the other hand, when the inner cover 300 is connected to the lower portion of the discharge guide 202, and the temperature adjusting device 150 is close to the lower surface of the inner case 8, the length of the inner cover 300 in the vertical direction Z may be short, and the volume occupied by the storage space in the storage chamber W may be large. When the upper end height H1 of the temperature adjusting device 150 is lower than the lower end height H2 of the partition member 3, the portion of the inner cover 300 facing the first space W1 may be minimized or absent, and the volume of the first space W1 may be maximized.

A portion of the discharge guide 202 facing the first space W1 may include a heating air generation module (HG) module 184 and a temperature sensor T2. The HG module 184 may further include an air purification filter.

The inner guide 200 may further include an air guide 400. The fan 181 may be provided inside the air guide 400 and may be received in the air guide 400. The air guide 400 may be connected to the lower end of the discharge guide 202. The air guide 400 and the temperature adjusting device 150 may be covered by the inner cover 300. The air guide 400 may be formed with a shroud 411 opened toward the temperature adjusting device 150, and when the fan 181 is driven, the air heat exchanged with the temperature adjusting device 150 may pass through the shroud 411 to flow into the air guide 400.

The air guide 400 may overlap the temperature regulating device 150 in the front and rear direction X or in the vertical direction Z. When the air guide 400 and the temperature adjusting device 150 overlap in the front and rear direction X, the length of a space in which the air guide 400 and the temperature adjusting device 150 occupies in the vertical direction may be short while the width of the space in the front and rear direction may be large. In this case, the width L1 of the inner cover 400 in the front and rear direction X may also be large, and the width of the second space W2 in the front and rear direction X may be small.

The inner cover 300 may include a receiving member discharge port 331 through which the air blown from the receiving member fan 183 passes to be blown toward the receiving member. The inner cover 300 may include a receiving member fan mounting portion 330 on which the receiving member fan 183 is mounted. The receiving member fan 183 may be provided in the inner cover 300.

The refrigerator may further include a receiving member cover 2' facing the upper surface of the receiving member 4. The receiving member cover 2' may be provided on the shelf 2 disposed in the second space W2. The receiving member cover 2' may be spaced apart from the upper end of the receiving member 4, and the air discharged through the receiving member discharge port 331 may flow to the receiving space P of the receiving member (4) through the gap between the receiving member cover 2' and the receiving member 4.

The discharge guide 202 may be formed of a combination of a plurality of members. The discharge guide 202 may further include a discharge body 210 and a flow path body 230 disposed on the rear surface of the discharge body 210. The discharge guide 202 may further include a cover body 220 spaced apart from the discharge body 210 in the front and rear direction. Discharge ports 204 and suction ports 205 may be formed in the discharge body 210.

The flow path body 230 may be provided in the discharge body 210 to form a discharge flow path P2 for guiding air to the discharge port 204. The flow path body 230 may form a discharge flow path P2 for guiding the air heat exchanged with the temperature adjusting device 150 to the discharge port 204. The flow path body 230 may be provided between the discharge body 210 and the cover body 220.

The discharge guide 202 may further include an outer plate 250 disposed on the front surface of the discharge body 210. The outer plate 250 may form an outer appearance of the rear wall surface of the first space W1 and may be formed of a metal material such as stainless steel.

The outer plate 250 may have openings 251, 252, 253, and 255 having sizes corresponding to positions corresponding to the discharge ports 204, the purification module mounting portion 212, the temperature sensor mounting portion 213, and the suction port 205, respectively. The cover body 220 may have a plate shape and may be spaced apart from the discharge body 210 by the flow path body 230.

The discharge flow path P2 may be defined as an area in which the flow path body 230 is not located among the areas between the discharge body 210 and the cover body 220. The lower end of the discharge flow path P2 may communicate with the air guide 400, and may be branched to both left and right sides by the first member 231 and may extend upward. The first member 231 may be formed such that the left and right widths become wider from the lower end to the upper side, and both left and right side surfaces may be formed to have a predetermined curvature to provide a smooth flow of air.

A purification module recessed portion 231*a* may be further formed on the upper portion of the first member 231 so that the purification module 184 may be recessed thereon, and if necessary, the first member 231 may further include a flow path for allowing air in the first space W1 to enter and exit the purification module 184. The second member 232 and the third member 233 may be spaced apart from the left and right sides of the first member 231 to form the discharge flow path P2, and the sides of each of the second and third members 232 and 233 facing the first member 231 may be formed round in a shape corresponding to the sides of the first member 231. The discharge ports 204 formed in the discharge body 210 may be formed toward the discharge flow path P2 branched into a pair.

A through-hole 233*a* corresponding to the suction port 205 may be formed at one lower side of the third member 233, and the through-hole 233*a* may communicate with the return duct 500, which will be described later and thus the air recovered at the storage chamber W may flow into the return duct 500. The heat insulating sheet 290 may be provided on the rear surface of the discharge flow path P2 formed by the flow path body 230. The heat insulating sheet 290 may be formed in a shape corresponding to the shape of the discharge flow path P2 and may be attached to the front surface of the cover body 220.

The refrigerator may include a guide 234 for guiding air forcedly flowing by the fan 181 inside the air guide 400. Guide 234 may be formed to guide the air blown from the fan 181 to the outlet 412 which will be described later. To this end, the guide 234 may be formed to have a predetermined curvature. The guide 234 may be formed farther from the outer circumference of the fan 181 as the guide 234 approaches the outlet 412 in the air flow direction.

The guide 234 may be formed in the discharge guide 202 and may be inserted into the air guide 400 to be positioned around the fan 181. The guide 234 may be formed integrally with any one of the discharge body 210, the flow path body 230, and the cover body 220, and may be coupled to one of the discharge body 210, the flow path body 230, and the cover body 220. The guide 234 may be formed to protrude from the lower portion of the flow path body 230, and, for example, the guide 234 may be formed to protrude from the third member 233.

The discharge flow path P2 may have an inlet (PA) through which air flows into the discharge flow path P2. The inlet PA may be eccentrically positioned on the inner guide 200. The inlet PA may be closer to any one of one end and the other end of the inner guide 200.

A plurality of discharge ports 204 may be provided in the inner guide 200. The discharge flow path P2 may include a plurality of branch flow paths PB and PC communicating with the inlet PA and communicating with the discharge port 204. The discharge port 204 may be formed in each of the branch flow paths PB, PC. The plurality of discharge ports 204 may include a first discharge port closer to one end of the one end and the other end of the air guide 200, and may include a second discharge port closer to the other end of the one end and the other end of the air guide 200.

When a plurality of suction ports 205 through which the air in the first space W1 is suctioned are formed in the inner guide 200, a plurality of inlet portions may be formed in the return duct 500, and in this case, the air in the first space W1 may be suctioned into the return duct 500 through the plurality of suction ports and the plurality of inlet portions. On the other hand, when a single suction port 205 may be formed in the inner guide 200, the air in the storage space may be suctioned into the return duct 500 through the single suction port 205. When a single suction port 205 is formed in the refrigerator, the return duct 500 may be provided with a single inlet portion 510 so that the structure of the return duct 500 may be simple and the refrigerator may be manufactured more compactly.

The suction port 205 may be formed at a position where the first centerline Z1 of the inner guide 200 passes or may be formed at a position closer to the first centerline Z1 among one end, the other end, and the first centerline Z1 of the inner guide 200. The suction port 205 may be formed to overlap the discharge flow path P2 in the horizontal direction. The suction port 205 may be formed at a height overlapping the inlet PA in the horizontal direction.

Each of the suction ports 205 and the inlet PA may have a predetermined length in the horizontal direction and may be located as close to the first centerline Z1 as possible. The suction port 205 may be closer to one side of the inner guide 200, and the inlet PA may be closer to the other side of the inner guide 200.

The distance L4 between the second centerline Z2 and the first centerline Z1 of the suction port 205 may be shorter than the distance L5 between the second centerline Z2 and one end of the inner guide 200. For example, the suction port 205 may be closer to the first centerline Z1 than one end of the inner guide 200.

The distance L4 between the second centerline Z2 and the first centerline Z1 may be shorter than the distance L6 between the third centerline Z3 and the second centerline Z2 of the inlet PA. For example, the suction port 205 may be closer to the first centerline Z1 than to the inlet PA.

The distance L6 between the third centerline Z3 and the second centerline Z1 may be shorter than the distance L5 between the second centerline Z2 and one end of the inner guide 200. For example, the suction port 205 and the inlet PA may be located as close as possible.

Here, the first centerline Z1 may be a vertical centerline for dividing the inner guide 200 in the left and right direction, and the second centerline Z1 may be a vertical centerline for dividing the suction port 205 in the left and right direction, and the third centerline Z3 may be a vertical centerline that divides the entrance PA in the left and right direction. In addition, one end of the inner guide 200 may be any one of the left end 200A and the right end 200B of the inner guide 200, and the other end of the inner guide 200 may be the other of the left end 200A and the right end 200B of the inner guide 200. In this case, the portion between the left end 200A and the first centerline Z1 of the inner guide 200 may be a left body portion of the inner guide 200, and the portion between the right end 200B and the first centerline Z1 of the inner guide 200 may be a right body portion of the inner guide 200.

Hereinafter, the suction port 205 will be described below as an example in which the inlets PA are spaced apart in the left and right direction Y, one end of the inner guide 200 is the left end 200A of the inner guide 200, and the other end of the inner guide 200 is the right end 200B of the inner guide 200. When the inlet port 510 is closer to the left end 200A of the left end 200A and the right end 200B, the air in the first space W1 may chiefly pass through the front of the left body portion and then may be suctioned into the suction port 205. On the contrary, if the suction port 205 is closer to the right end 200B of the left end 200A and the right end 200B, the air in the first space W1 may chiefly pass through the front of the right body portion, and then may be suctioned into the suction port 205.

The goods having a large quality change according to the temperature change may be stored in the first space W, and the suction port 205 may be formed at a position where the left and right temperature deviation of the first space W1 can be minimized. The inlet port 510 may be formed at a position where the first centerline Z1 can penetrate the suction port 205 or may be formed at a position closest to the first centerline Z1 among the first centerline Z1, the left end 200A, and the right end 200B.

Any one of the suction port 205 and the inlet PA may be closer to the first centerline Z1 than the other. When the suction port 205 is closer to the first centerline Z1 than the inlet PA, the left and right temperature variations of the first space W1 may be minimized. When the inlet PA is closer to the first centerline Z1 than the suction port 205, the degree or number of bends of the discharge flow path P2 may be minimized and the flow path resistance of the discharge flow path P2 may be minimized.

The refrigerator may minimize left and right temperature variations, and the inlet PA may be eccentrically positioned closer to one of the left end 200A and the other end 200B of the inner guide 200, the suction port 205 may be formed at a position through which the first centerline Z1 penetrates, or may be formed at a position closer to the first centerline Z1 among the first centerline Z1, the left end 200A, and the right end 200B, and in this case, the suction port 205 may be located closer to the opposite side end of the side end near the inlet PA of the left end 200A and the right end 200B.

For example, when the inlet PA is closer to the right end 200A among the left end 200A and the right end 200B, the suction port 205 may be formed at a position through which the first centerline Z1 penetrates or may be located closer to the first centerline Z1 of the left end 200A and the right end 200B and the first centerline Z1, and the suction port 205 may be closer to the left end 200A of the left end 200A.

The air guide 400 may be a fan housing that surrounds the fan 181. An inner air flow path may be formed in the air guide 400 in which air heat-exchanged with the temperature adjusting device 150 is distributed to the first damper 191 and the second damper 192.

The first damper 191 and the second damper 192 may be installed in the air guide 400. The air guide 400 may be a damper built-in fan housing. In this case, the air guide 400 may be a fan housing capable of guiding the air flowing by the fan 181 to the first damper 191 and the second damper 192.

The air guide 400 may be coupled to the lower end of the discharge body 210, and the fan 181, the first damper 191, and the second damper 192 may be provided inside the air guide 400. When the first damper 191 and the second damper 192 are operated when the fan 181 is driven, the refrigerator may allow air that is heat-exchanged with the temperature adjusting device 150 to be selectively supplied to the first space W1 and the second space W2.

The air guide 400 may include a front housing 410 and a rear housing 420, and the fan 181, the first damper 191, and the second damper 192 may be received in the space formed by the combination of the front housing 410 and the rear housing 420. The fan 181 may be a centrifugal fan or a turbofan that suctions in the axial direction and discharges in the circumferential direction.

The air guide 400 may have a scroll (or conduit) 413 and an opening portion 414 for guiding air to the discharge flow path P2. The scroll 413 may guide the air blown from the fan 181 to the opening portion 414. The scroll 413 may be formed to have a predetermined curvature. The scroll 413 may be formed far from the outer circumference of the fan 181 as it approaches the opening portion 414 in the air flow direction. The opening portion 414 may communicate with the lower end of the discharge flow path P2.

The first damper 191 may interrupt the flow of air through the opening portion 414. The first damper 191 may interrupt the flow of the air flowing in the fan 181 to the discharge flow path P2. The air supply of the discharge flow path P2 may be determined when the first damper 191 is opened and closed.

The first damper 191 may be provided in the opening portion 414 and may be provided before the opening portion 414 or after the opening portion 414 in the air flow direction. When the first damper 191 is provided in the opening portion 414 in the air flow direction, the first damper 191 may be provided in the air guide 400.

The discharge guide 202 may be as slim as possible so that the volume of the first space W1 is maximized. In addition, the width of the first damper 191 in the front and rear direction may be greater than the width of the discharge guide 202 in the front and rear direction. When the width of the first damper 191 in the front and rear direction is larger than the width of the discharge guide 202 in the front and rear direction, the first damper 191 may be positioned before the opening portion or in the opening portion in the air flow direction. The first damper 191 may be provided in the air guide 400.

The air guide 400 may have a shroud 411 through which air may be suctioned into the fan 181. The shroud 411 may be formed in the front housing 410. When the fan 181 is driven, air in front of the front housing 410 may be suctioned into the air guide 400 through the shroud 411 and may be discharged in the circumferential direction of the fan 181.

The first damper 191, the second damper 192, the fan 181, the air guide 400, and the temperature adjusting device 150 may be received in the inner cover 300, and may be located as close as possible. For example, the positions of each of the first damper 191, the second damper 192, and the fan 181 may be determined by the air guide 400, and if the air guide 400 overlaps the evaporator 140 in the vertical direction Z, at least a portion of each of the first damper 191, the fan 181, and the second damper 192 may be overlapped with the temperature adjusting device 150 in the vertical direction Z.

The first damper 191 and the second damper 192 may be spaced apart in the horizontal direction, particularly in the left and right directions Y, and a portion of the fan 181 may be located between the first damper 191 and the second damper 192. At least a portion of the first damper 191 may overlap the fan 191 in the horizontal direction, For example, the left and right directions Y. The first damper 191 may be eccentrically provided on one side of the left and right sides of the air flow path P. The first damper 191 may be arranged at a height H3 overlapping the partition member 3 in the horizontal direction, particularly in the front and rear direction X.

The first damper 191 may overlap the partition member 3 in the horizontal direction when a portion of the air guide 200 is interposed between the first damper and the partition member 3. The first damper 191 may overlap the rear end of the partition member 3 in the front and rear direction X when the air guide 400 is arranged between the first damper and the inner cover 300.

At least a portion of the second damper 192 may overlap the fan 191 in a horizontal direction, For example, in a left and right direction Y. The second damper 192 may be provided eccentrically to the other side of the air flow path P in the left and right direction. At least a portion of the second damper 192 may overlap the partition member 3 in the horizontal direction, For example, in the front and rear direction X.

The second damper 192 may overlap the partition member 3 in the horizontal direction, For example, the front and rear direction X, when a portion of the inner guide 200 is interposed between the second damper and the partition member 3. A portion of the inner cover 300 and a portion of the air guide 400 of the inner guide 200 may be located between the partition member 3 and the second damper 192. The second damper 192 may overlap the rear end of the partition member 3 in the front and rear direction X in a state where the air guide 400 is disposed between the inner cover 300 and the second damper 192.

When the first damper 191, the second damper 192, and the fan 181 are provided at the above positions, the size of the air guide 400 may be minimized, and the first damper 191, the second damper 192, the fan 181, the air guide 400, and the temperature adjusting device 150 may be provided as compactly as possible in the inner case 8. An outlet 412 communicating with the additional discharge port 321 may be formed in the air guide 400, For example, the front housing 410. The outlet 412 may face the additional discharge port 321 to discharge air to the additional discharge port 321, and may also communicate with the additional discharge port 321 through the discharge duct 360. The outlet 412 may be spaced apart from the opening portion 414 through which the discharge flow path P2 communicates.

The inner guide 200 may further include a discharge duct 360 that guides the air passing through the outlet 412 to the additional discharge port 321 after being circulated by the fan 181. The discharge duct 360 may connect the air guide 400 and the inner cover 300, and guide the air blown from the air guide 400 to the additional discharge port 321. The discharge duct 360 may form an air flow path P3 (for example, an additional discharge flow path P3) so that the air blown by the fan 181 may be directed to the additional discharge port 321.

The discharge duct 360 may include an inlet portion 361 connected to the second damper 192 and an outlet portion 362 connected to the additional discharge port 321. The inlet portion 361 and the outlet portion 362 may extend in a direction crossing each other. The outlet portion 362 may extend in the horizontal direction from the inlet portion 361 to be lengthened and may be formed to open forward. The outlet portion 362 may face the additional outlet port 321. An edge 363 which is in close contact with the inner cover 300 may be formed on the front surface of the outlet portion 362.

The additional discharge holes 321 may face the inner region of the outlet portion 362 in the front and rear direction X, and all of the air guided through the discharge duct 360 may be discharged to the second space W2 through the additional discharge holes 321. The outlet 412 may be spaced apart from the shroud 411 and the opening portion 414 in the air guide 400, and the outlet 412 may be an air guide discharge port for supplying air to the second space W2.

The second damper 192 may be located before the outlet 412 in the air flow direction, and the second damper 192 may adjust the air flow through the outlet 412. When the fan 181 is driven and the second damper 192 is opened, the air heat exchanged with the temperature adjusting device 150 may be supplied to the second space W2 through the discharge duct 360.

When the second damper 192 is embedded in the air guide 400, a second separate damper receiver may not need to be formed in the inner cover 300, and a portion of the inner cover 300 which protrudes toward the second space W2 may be minimized and the volume of the second space W2 may be maximized.

A fan motor mounting portion 421 in which the fan 181 is mounted may be formed in the air guide 400. For example, the rear housing 420. The first damper mounting portion 422 may be formed on one side of the left and right sides of the fan motor mounting portion 421, and the second damper mounting portion 423 may be formed on the other side of the fan motor mounting portion 421. The first damper mounting portion 422 and the second damper mounting portion 423 may be positioned opposite to each other in a state where the fan motor mounting portion 421 is interposed between the first damper mounting portion 422 and the second damper mounting portion 423.

The refrigerator may discharge air into the first space W1 from the storage chamber W, particularly from the upper portion of the first space W1. The flow path body 230 may extend to the upper end of the discharge body 210, and the upper end of the flow path body 230 may be coupled to the duct connecting member 270. In addition, the inner case 8 may be an upper duct 280 for guiding air to be discharged into the first space W1.

The upper duct 280 may be provided on the upper surface of the inner case 8. The upper duct 280 may include an inner flow path for guiding the air passing through the discharge flow path P2 to be discharged into the first space W1, and a top discharge port through which the air guided in the inner flow path may be discharged to the first space W1. The top discharge port may be formed under the upper duct 280 and may be open toward the first space W1.

The duct connecting member 270 may allow the interior of the discharge flow path P2 and the upper duct 280 to communicate with each other and may be mounted on the upper end of the passage body 230. The duct connecting member 270 may include a connecting portion 272 connecting between the pair of flow passage portions 271 and the pair of flow passage portions 271 respectively connected to the discharge flow path P2 and the upper duct 280.

The duct connecting member 270 may penetrate the inner case 8 and may connect the upper end of the discharge guide 202 inside the inner case 102 and the rear end of the upper duct 280 outside the inner case 102. A pair of upper ducts 280 may be provided in the refrigerator. The upper duct 280 may penetrate the inner case 8, and the top discharge port may face the first space W1.

The inner guide 200 may be connected to a return duct 500 for recovering air in the first space W1 to the temperature adjusting device 150. The return duct 500 may be connected to the inner guide 200 in communication with the suction port 205. The return duct 500 may guide the air suctioned into the suction port 205 to the temperature adjusting device 150 provided in the air flow path P.

The return duct 500 may include an inlet portion 510 through which air is suctioned. The inlet portion 510 may be formed on the upper portion of the return duct 500. The return duct 500 may further include a discharge unit or port 520 for discharging air to a temperature adjusting device, for example, the temperature adjusting device 150 disposed in the air flow path P. The discharge portion 520 may be formed under the return flow path 500.

The inlet portion 510 of the return duct 500 may be closer to the first centerline Z1 of the first centerline Z1 of the inner guide 200 and the side ends 200A and 200B of the inner guide 200 or can face the first centerline Z1. The outlet portion 520 of the return duct 500 may guide the air toward the central region of the temperature adjusting device as much as possible, in particular the evaporator 150, the outlet 520 of the return duct 500 may face the centerline (Z1).

The inner case 8 may have a through-hole 8A through which a portion of the return duct 500 may pass. The through-hole 8A may be formed at the position facing the air guide 400, particularly the rear housing 420, of the inner case 8. In addition, an inlet 424 corresponding to the inlet portion 510 may be formed in the air guide 400. The inlet 424 may be formed in the rear housing 420 of the air guide 400.

The inlet 424 may be formed at a position corresponding to the suction portion 205 and the inlet portion 510 and may be in communication with each of the suction port 205 and the inlet portion 510. For example, the suction port 205 and the return duct 500 may communicate through the inlet 424 formed in the air guide 400.

The inner case 8 may have an outlet 8B corresponding to the outlet portion 520. The outlet 8A may face the lower end of the temperature adjusting device 150 or downward of the temperature adjusting device 150. The outlet 8B may be in communication with the outlet portion 520. The heat exchange flow path P1 and the return duct 500 in which the temperature adjusting device 150 is received may communicate through the outlet 8B formed in the inner case 8. The outlet 8A may be formed at a lower height than the additional discharge port 321 and the receiving member discharge port 331.

The inlet portion 510 may be in communication with the suction port 205. The outlet portion 520 may face the temperature adjusting device 150 or the lower side of the temperature adjusting device 150. The outlet portion 520 may face the lower portion of the temperature adjusting device 150.

The return duct 500 connects the inlet portion 510 and the outlet portion 520 and may include a body portion 530. The body portion 530 may include a return flow path P4 for guiding the air suctioned in the first space W1 to the temperature adjusting device 150.

The size of the outlet portion 520 may be larger than that of the inlet portion 510, and the body portion 530 may be formed to be wider toward the outlet portion 520. The air flowing into the temperature adjusting device 150 through the outlet portion 520 may be supplied to the widest area of the temperature adjusting device 150.

The return duct 500 may include an overlap portion 532 overlapping the fan 191 in the front and rear direction X. The overlap portion 532 may be positioned behind the fan 191 in a state where the air guide 200. For example, a portion of the rear housing 420 is interposed between the overlap portion and fan. The fan motor mounting portion 421 formed in the rear housing 420 may be positioned between the fan 191 and the overlap portion 532, and the front surface of the fan motor mounting portion 421 may face the fan 191.

The rear surface of the fan motor mounting portion 421 may face the overlap portion 532. For example, the overlap portion 532 may overlap the fan 191 in the front and rear direction X in a state where the fan motor mounting portion 421 is interposed between the overlap portion 532 and the fan 191.

In the return duct 500, an expansion portion 534 may be formed at a lower side of the overlap portion 532 to extend in a horizontal direction. For example, in a left and right direction Y, toward the outlet portion 520. The expansion portion 534 may gradually expand as the return flow path P4 goes downward, and after the air passing through the return duct 500 spreads wide in the left and right directions Y while passing through the expansion portion 534, the air may flow to the temperature adjusting device 150.

Figure 22:
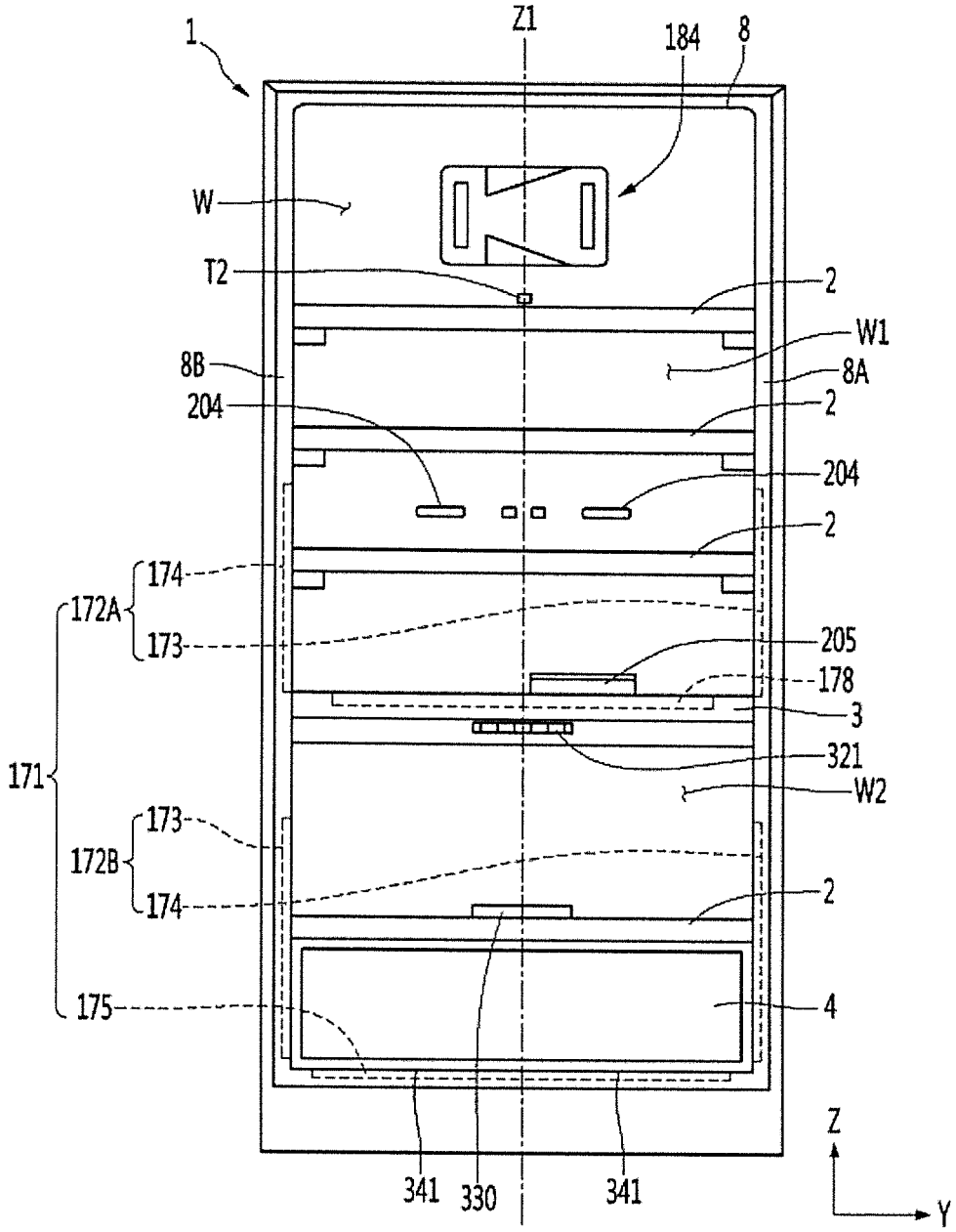
FIG. 22 is a front view illustrating a heating device according to an embodiment of the present disclosure.

Referring to FIG. 22, the refrigerator of the present embodiment may include a heating device for heating the storage space, and the refrigerator may perform the heating mode H (see FIG. 4) using the heating device. The heating device may be constituted by an electric heater such as a hot wire heater or a planar heater or can be constituted by a heat generating body of a thermoelectric element. The heating device is not limited to the type, and various devices may be applied as long as the heating device is capable of generating heat of approximately 20° C. or more.

The heating device can be operated independently of the temperature adjusting device disposed in the air passage P. The refrigerator may perform the cooling mode E (see FIG. 4) by the temperature adjusting device disposed in the air flow path P and may perform the heating mode H by the heating device.

The heating device may be provided in addition to the air flow path P. The heating device may increase the temperature of the storage space, and in consideration of energy efficiency, the heating device may be installed at a position that is thermally separated from the temperature adjusting device disposed in the air flow path P.

The inner guide 200 may be cooled by a temperature adjusting device disposed in the air flow path P, and the heating device may be provided in addition to the inner guide 200. The heating device may be arranged so that a specific region of the storage space is not supercooled, and may heat a region that is more relatively easily subcooled than other regions of the storage space.

The air discharged from the discharge port 204 may fall and be suctioned through the suction port 205, and a region of the storage space which is close to the suction port 205 may be a region that is relatively easy to be supercooled than a region far from the suction port 205. The heating device may be installed in close proximity to the suction port 205 and may heat an area of the storage space which is close to the suction port 205.

When the refrigerator further includes a partition member 3 that partitions the first space W1 and the second space W2, the air discharged from the additional discharge port 321 to the second space W2 may be dropped to suction through the additional suction port 341, and a region of the second space W2 which is close to the additional suction port 341 may be a region that is relatively more easily subcooled than an area farther from the additional suction port 341. The heating device may be installed in proximity to the additional suction port 341 and may heat a region of the storage space in proximity to the additional suction port 341.

The heating device may be arranged in a configuration other than the inner guide 200 among the components located inside the inner case 8 or may be disposed in an area of the inner case 8 which does not face the inner guide 200. For example, the heating device may be disposed in the inner case 8 or in the storage space. For example, the heating device may include an inner case heating device 171 disposed in the inner case 8, and the inner case heating device 171 may be provided at a position in the inner cases 8 which does not face the air flow path P. The inner case heating device 171 may be arranged on each of the left side plate, the right side plate, the lower plate, and the upper plate of the inner case 8. The inner case heating device may be installed in a portion of the inner case 8 which is more easily cooled than the other portion.

The inner case heating device 171 may be in contact with the outer surface of the inner case 8 to heat the inner case 8 and the air in the storage space may be heated by the inner case 8. The inner case heating device 171 may be provided on the inner surface of the inner case 8 to heat the inner case 8 and the storage space. On the other hand, the inner surface of the inner case 8 may be formed with a receiving groove which may be capable of receiving the inner case heating device 171, and the inner case heating device 172 may heat a storage space and the inner case in a state of being received in the receiving groove.

The inner case heating device 171 may include a side heating device provided on the side plate of the inner case 8. The side heating device may include a left heating device 173 disposed on the left side plate 8A of the inner case 8 and a right heating device 174 disposed on the right side plate 8B of the inner case 8. The side heating device may be installed for each of the first space W1 and the second space W2. In this case, the side heating device may include a first heating device 172A for heating the first space W1 and a second heating device 172B for heating the second space W2.

In some examples, the side heating device 172 may heat only the space W1 of the relatively high storage temperature range of the first space W1 and the second space W2. In this case, the side heating device 172 may be installed only at a portion of the left side plate and the right side plate of the inner case 8 facing the first space W1 and may not be installed at the portion facing the second space W2.

The inner case heater 171 may further include a lower heating device 175 provided on the lower plate of the inner case 8. The lower heating device 175 may be installed in proximity to the additional suction port 341. The lower heating device 175 may be installed to heat the lowermost region of the second space W2.

The heating device may include an inner heating device (or inner heater) 178 disposed in the storage space. The refrigerator may include a shelf 2 or a partition member 3 provided in the storage space, and the inner heating device 178 may be provided on the partition member 3 or the shelf 2 and can heat the partition member 3 or the shelf 2.

The inner heating device 178 may not be disposed on the partition member 3 or the shelf 2 but may be mounted on a heating body separately disposed in the storage space. For example, the inner heating device 178 may be disposed on the partition member 3, the shelf or, the heating body the storage space, and heat the air in the storage space. The inner heating device may be built in the partition member 3, the shelf 2, or the heating body, and may heat the storage space by heating the partition member 3, the shelf 2 or the heating body.

The inner heating device 178 may be exposed to the outer surface of the partition member 3, the shelf 3 or the heating body to directly heat the air in the storage space. The inner heating device 178 may be heated before the air in the storage space is suctioned into the suction port 205. The inner heating device 178 may be provided in a region of the storage space close to the suction port 205 of a region of the storage space close to the suction port 205 and a region of the storage space far from the suction port 205.

The inner heating device 178 may heat the lowermost region of the first space W1 and may be installed in the partition member 3. The inner heating device 178 may be provided in the partition member 3 close to the suction port 205, the suction port 205 may face upward of the inner heating device 178, and the air around the partition member 3 may be quickly heated by the partition member 3 and the inner heating device 178.

A refrigerator according to an embodiment of the present disclosure may include a cabinet configured to be formed with a storage chamber; an inner guide configured to partition the storage chamber into a storage space and an air flow path and be formed with a discharge port and a suction port; and a temperature adjusting device configured to be disposed in the air flow path.

The inner guide may be formed with a discharge flow path for guiding air discharged to the discharge port. The discharge flow path may have an inlet closer to one of one end and the other end of the inner guide. The suction port may be formed at a position where a first centerline of the inner guide passes or is formed at a position closer to the first centerline among one end, the other end, and the first centerline of the inner guide. The suction port may be formed at the height overlapping the inlet in a horizontal direction. The suction port may be closer to the one end of the one end and the other end of the inner guide and the inlet may be closer to the other end of the one end and the other end of the inner guide.

A distance between the second centerline of the suction port and the first centerline may be shorter than a distance between the second centerline and one end of the inner guide. A distance between the second centerline and the first centerline may be shorter than a distance between a third centerline of the inlet and the second centerline. A distance between the third centerline and the second centerline may be shorter than a distance between the second centerline and one end of the inner guide.

A plurality of discharge ports may be provided in the inner guide. The discharge flow path may include a plurality of branch flow paths that communicate with the inlet and communicate with the discharge ports. The temperature adjusting device may include an evaporator closer to a lower end of an upper end and the lower end of the storage chamber.

The refrigerator may further include a partition member configured to partition the storage space into the first space and the second space. The discharge port and the suction port may face the first space.

The inner guide may further include an additional discharge port and an additional suction port facing the second space. The partition member may face between the suction port and the additional discharge port. The suction port and the additional discharge port may have a region overlapping each other in the vertical direction. The suction port may be spaced apart from a rear end of the partition member in the horizontal direction.

The partition member may be closer to a lower end of an upper end and the lower end of the storage chamber. The refrigerator may further include a return duct configured to guide air suctioned into the suction port to the temperature adjusting device. The return duct may include an inlet portion through which air is suctioned.

The inlet portion may be closer to the first centerline among the one end, the other end, and the first centerline of the inner guide or may face the first centerline. The return duct may further include an outlet portion for discharging air to the temperature adjusting device. The outlet portion may face the first centerline. The return duct may include an overlap portion overlapping the fan in a front and rear direction.

The refrigerator may further include a see-through door configured to open and close the storage space. The partition member may face a rear surface of the see-through door when the see-through door is closed. A transparent gasket may be disposed on the see-through door which is in contact with the partition member.

A refrigerator may include a cooling device configured to be disposed in the air flow path, and an inner heating device configured to heat the storage space. The suction port may face an upper side of the inner heating device. The heating device may be disposed in the partition member.

A refrigerator may include a see-through door configured to open and close the storage space and to be activated to see through the storage space so as to be capable of seeing the storage space.

The inlet of the discharge flow path may be eccentrically positioned at an inner guide so that the suction port is formed at a position where the first centerline of the inner guide passes or is formed as close as possible to the first centerline to minimize temperature variation in the storage chamber.

In addition, the suction port may be formed at a height overlapping the inlet of the discharge flow path in a horizontal direction so that a plurality of branch flow paths connected to the inlet can be formed in the widest area without interfering with the suction port, and the discharge port formed in each of the plurality of branch flow paths may be spaced apart from each other with a sufficient distance, and thus the air guided to the discharge flow path may be spread as evenly as possible into the storage chamber.

In addition, the inlet may be formed in close proximity to the suction port, the bending of the flow path of the discharge flow path can be minimized, and air can be quickly discharged and guided to the storage chamber. In addition, the partition member may suction air into the suction port, guide air and guide air discharged to an additional discharge port so that the partition member can help the rapid flow of the air.

In addition, since the additional discharge port overlaps the suction port in the vertical direction, the additional discharge port may discharge air at the center of the second space as much as possible, thereby minimizing the temperature deviation in the second space. In addition, the flow path bending of the return duct may be minimized, flow path loss by the return duct can be minimized, and rapid flow of air can be enabled. In addition, when goods having a large quality change due to a temperature change is received in the storage chamber, the goods may be stored at the uniform temperature as much as possible while minimizing frequent opening and closing of the door.

In an implementation, a refrigerator may comprise a cabinet having an interior space; a wall configured to partition the interior space into a storage space and an air flow path, the wall including a discharge port and a suction port; and a heat exchanger in communication with the air flow path, wherein the air flow path includes a discharge flow path that guides air to the discharge port, wherein the discharge flow path has an inlet formed closer to a first side edge of the wall than a second side edge of the wall, and wherein the suction port is positioned so that a vertical centerline of the wall extends through the suction port or a vertical centerline of the suction portion is closer to the vertical centerline of the wall than to the first and second side edges of the inner guide wall.

In an implementation, a refrigerator may comprise a cabinet having an interior space; a panel configured to partition the interior space into a storage space and an air flow path, the wall including a discharge port and a suction port; a heat exchanger in communication with the air flow path; and a heater configured to heat the storage space, wherein a vertical centerline of the suction port closer to the centerline of the wall than to a first side edge or a second side edge of the wall, and wherein the suction port is provided above a surface heated by the heater.

In an implementation, a refrigerator may comprise a cabinet having a storage space; an air flow path provided on a wall of the cabinet and having discharge port and a suction port to the storage space; a refrigeration system provided in the air flow path to receive air via the suction port and to output air via the discharge port; and a door configured to open and close the storage space, wherein a distance between a vertical centerline of the suction port and a vertical centerline of the wall is less than horizontal distances between the vertical centerline of the suction port and first side and second side edges of the wall.

This application is also related to U.S. Application No. filed, U.S. Application No. filed, U.S. Application No. filed, U.S. Application No. filed, U.S. Application No. filed, U.S. Application No. filed, and U.S. Application No. filed, the entire contents of which are hereby incorporated by reference.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element (s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator comprising:

a cabinet having an interior space;

a wall configured to partition the interior space into a storage space and an air flow path, the wall including a discharge port and a suction port;

a partition to separate the storage space into a first space and a second space, wherein the discharge port and the suction port communicate with the first space;

a heat exchanger in communication with the air flow path, wherein the air flow path includes a discharge flow path that guides air to the discharge port, wherein the discharge flow path has an inlet formed closer to a first side edge of the wall than a second side edge of the wall, and wherein the suction port is positioned so that a vertical centerline of the wall extends through the suction port or a vertical centerline of the suction port is closer to the vertical centerline of the wall than to the first and second side edges of the wall;

a fan disposed at an outlet side of the heat exchanger; and an inner cover configured to shield the heat exchanger and the fan, the inner cover including:

a cover body to define an inner wall of the second space such that the cover body is exposed to the second space; and an additional discharge port formed in the cover body such that a first volume of the air passing through the fan flows to the discharge port and a second volume of the air passing through the fan flows to the additional discharge port, and wherein the additional discharge port includes an opening through which the air is directly discharged to the second space, and the vertical centerline of the wall extends through the opening.

2. The refrigerator of claim 1, wherein the suction port is positioned to overlap at least a portion of the inlet of the discharge flow path in a horizontal direction.

3. The refrigerator of claim 1, wherein the suction port is positioned closer to the second side edge of the wall than the first side edge.

4. The refrigerator of claim 1, wherein a distance between the vertical centerline of the suction port and the vertical centerline of the wall is less than a distance between the vertical centerline of the suction port and the second side edge of the wall.

5. The refrigerator of claim 1, wherein a distance between the vertical centerline of the suction port and the vertical centerline of the wall is less than a distance between a vertical centerline of the inlet and the vertical centerline of the suction port.

6. The refrigerator of claim 1, wherein a distance between a vertical centerline of the inlet and the vertical centerline of the suction port is less than a distance between the vertical centerline of the suction port and the second side edge of the wall.

7. The refrigerator of claim 1, wherein the heat exchanger includes an evaporator positioned closer to a lower end of the interior space than to an upper end of the interior space.

8. The refrigerator of claim 1, wherein the inner cover further includes an additional suction port having another opening through which the air in the second space is directly introduced, and wherein the vertical centerline of the wall extends through the opening and the another opening.

9. The refrigerator of claim 1, wherein the partition extends horizontally between the suction port and the additional discharge port.

10. The refrigerator of claim 1, wherein the suction port overlaps the opening of the additional discharge port in a vertical direction.

11. The refrigerator of claim 1, wherein the suction port is spaced apart from a rear end of the partition in a horizontal direction.

12. The refrigerator of claim 1, wherein the partition is provided closer to a lower end of the interior space than to an upper end of the interior space.

13. The refrigerator of claim 1, further comprising:

a return duct configured to guide air between the suction port and the heat exchanger.

14. The refrigerator of claim 13, wherein the return duct includes an inlet through which air is received from the suction port, and wherein the inlet is positioned closer to the vertical centerline of the wall than to the first and second side edges of the wall.

15. The refrigerator of claim 13, wherein the return duct further includes an outlet through which air is discharged to the heat exchanger, and wherein the vertical centerline of the wall passes through the outlet.

16. The refrigerator of claim 13, wherein the return duct includes an inlet through which air is received from the suction port, an outlet through which air is discharged to the heat exchanger, and a duct section provided between the inlet and the outlet that overlaps the fan of the heat exchanger in a horizontal direction.

17. The refrigerator of claim 1, further comprising:

a transparent door configured to open and close the storage space, wherein a front edge of the partition faces a rear surface of the transparent door when the transparent door is closed, and wherein a gasket is provided on the transparent door to contact the partition when the transparent door is closed.

18. A refrigerator comprising:

a cabinet having a storage space;

an air flow path provided on a wall of the cabinet and having discharge port and a suction port to the storage space;

a refrigeration system provided in the air flow path to receive air via the suction port and to output air via the discharge port; and a door configured to open and close the storage space, wherein a distance between a vertical centerline of the suction port and a vertical centerline of the wall is less than horizontal distances between the vertical centerline of the suction port and one of first side or second side edges of the wall, wherein the refrigerator further comprises a return duct configured to guide air between the suction port and the refrigeration system, the return duct including:

an inlet through which air is received from the suction port;

an outlet through which air is discharged to the refrigeration system; and a duct section that is provided between the inlet and the outlet, the duct section including an overlap portion configured to overlap a fan of the refrigeration system in a horizontal direction such that at least a portion of the wall is interposed between the fan and the overlap portion, wherein the wall includes a fan motor mounter in which a motor for the fan is mounted, the fan motor mounter being positioned between the fan and the overlap portion such that the fan motor mounter overlaps the overlap portion, and wherein a size of the outlet is greater than that of the inlet.

19. A refrigerator comprising:

a cabinet having an interior space;

a wall configured to partition the interior space into a storage space and an air flow path, the wall including a discharge port through which air is discharged to the storage space and a suction port through which the air in the storage space is introduced;

a heat exchanger in communication with the air flow path; and a fan configured to overlap the heat exchanger in a horizontal direction, wherein the air flow path includes a discharge flow path that guides air to the discharge port, wherein the discharge flow path includes an inlet formed closer to a first side edge of the wall than a second side edge of the wall and a plurality of branch flow paths extending towards the discharge port from the inlet, wherein the inlet of the discharge flow path is provided at an outlet side of the fan such that air passing through the fan is introduced into the plurality of branch flow paths via the inlet, and wherein the suction port is positioned so that a vertical centerline of the wall extends through the fan, and the inlet of the discharge flow path is opposed to the suction port with respect to the fan.

* * * * *